US008136379B2

(12) United States Patent
Itaya

(10) Patent No.: US 8,136,379 B2
(45) Date of Patent: Mar. 20, 2012

(54) HELICAL PART MANUFACTURING APPARATUS AND CONTROL METHOD THEREOF

(75) Inventor: Ichiro Itaya, Tokyo (JP)

(73) Assignee: Kabushiki Kaisha Itaya Seisaku Sho, Tokyo (JP)

( * ) Notice: Subject to any disclaimer, the term of this patent is extended or adjusted under 35 U.S.C. 154(b) by 951 days.

(21) Appl. No.: 12/156,689

(22) Filed: Jun. 3, 2008

(65) Prior Publication Data

US 2008/0302156 A1 Dec. 11, 2008

(30) Foreign Application Priority Data

Jun. 5, 2007 (JP) ..... 2007-149573
May 15, 2008 (JP) ..... 2008-128774

(51) Int. Cl.
*B21F 3/02* (2006.01)

(52) U.S. Cl. ..... 72/135; 72/20.2; 72/21.6; 72/129; 72/137; 72/145; 451/21

(58) Field of Classification Search ..... 72/20.1, 72/20.2, 20.3, 21.6, 129, 130, 131, 132, 135, 72/137, 140, 145, 324, 340; 83/74, 75, 529, 83/530; 451/21, 51
See application file for complete search history.

(56) References Cited

U.S. PATENT DOCUMENTS 3,478,402 A * 11/1969 Heinz et al. ..... 29/898.066
4,109,361 A * 8/1978 Hagen et al. ..... 29/898.066
5,259,226 A * 11/1993 Itaya ..... 72/138
5,285,669 A 2/1994 Itaya
5,887,471 A * 3/1999 Itaya ..... 72/142
6,000,265 A 12/1999 Itaya
6,178,852 B1 * 1/2001 Pfaff ..... 76/107.1
6,701,816 B2 * 3/2004 Smith ..... 83/74
7,159,430 B2 * 1/2007 Yogo ..... 72/129
7,343,766 B2 * 3/2008 Tsuritani ..... 72/135
7,473,162 B1 * 1/2009 Sung et al. ..... 451/21

FOREIGN PATENT DOCUMENTS

DE 25 36 562 2/1977
DE 2005 587 5/1983
DE 37 19816 A1 12/1988
GB 1 513 339 6/1978
JP 50-52687 5/1975

(Continued)

OTHER PUBLICATIONS http://www.heiwa-tec.co.jp.

(Continued)

*Primary Examiner* — Edward Tolan
(74) *Attorney, Agent, or Firm* — Merchant & Gould P.C.

(57) ABSTRACT

This invention provides an apparatus for manufacturing a helical part by feeding a wire W toward a pointing tool 21 and pushing the wire W against the pointing tool 21 to forcibly wind the wire. The apparatus comprises: a feed roller 12 for feeding the wire W toward the pointing tool 21; a wire feeding motor 111 for rotatably driving the feed roller; a grindstone tool unit 30, which holds a discoid grindstone 31 rotatable and movable, for cutting the wire W by the rotating discoid-grindstone 31; and a CPU 100 for controlling the wire feeding motor 111 and grindstone tool unit 30 to move the discoid grindstone 31 on a plane which is substantially perpendicular to a coil growing direction of the helical part and to cut the wire W in a direction which is substantially perpendicular to the coil growing direction.

8 Claims, 32 Drawing Sheets

FOREIGN PATENT DOCUMENTS

| | | |
|---|---|---|
| JP | 2004851 | 1/1990 |
| JP | 6-218476 | 8/1994 |
| JP | 06-218476 | 8/1994 |
| JP | 2889553 | 5/1999 |
| JP | 2003-340541 | 12/2003 |
| JP | 2004-330209 | 11/2004 |
| JP | 3854242 | 12/2006 |

OTHER PUBLICATIONS http//:www.discousa.com/jp/products/catalog/index/html.

Office Action mailed Feb. 2, 2009 for pending Japanese equivalent application 2008-128774 and English translation.

* cited by examiner

FIG. 9A
FIG. 9B
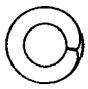
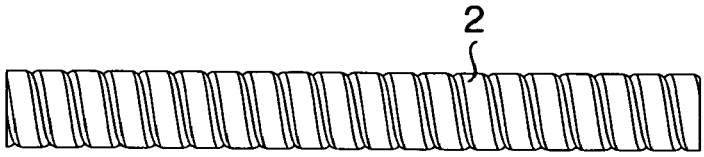
FIG. 9C
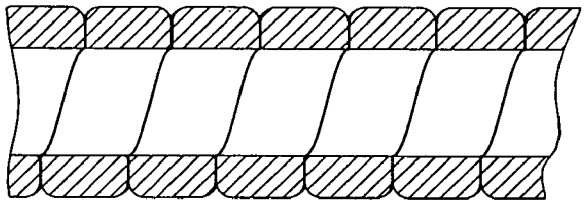

HELICAL PART MANUFACTURING APPARATUS AND CONTROL METHOD THEREOF

CROSS-REFERENCE TO RELATED APPLICATION

This application is entitled to the benefits of Japanese Patent Application Nos. 2007-149573, filed Jun. 5, 2007 and 2008-128774, filed May 15, 2008.

BACKGROUND OF THE INVENTION

1. Field of the Invention

The present invention relates to a manufacturing technique of helical parts, typically exemplified by coil springs or the like.

2. Description of the Related Art

Conventionally, a spring has been manufactured by helically winding a wire by a spring manufacturing apparatus which serves as a helical part manufacturing apparatus, and then both ends of the spring are processed into flat surfaces with the use of a grinding machine which is provided differently from the spring manufacturing apparatus. The necessity of the differently provided grinding machine has been causing problems in terms of costs and machine installing locations. Also, the grinding process necessary in addition to the spring manufacturing process has been causing reduced production efficiency.

In order to solve the problems, the conventional techniques have proposed to push the wire fed out by a feed roller against a tool and helically wind the fed wire, thereafter irradiate a laser beam from the outer circumference of the helicoid for cutting the wire, or emit jet water for cutting the wire (refer to Japanese Patent No. 2004851 (U.S. Pat. No. 5,285,669) and Japanese Patent No. 3854242).

Furthermore, a discoid grindstone is commercially available these days as a grindstone that can be used in board material cutting machines. The discoid grindstone can precisely cut hard and brittle materials such as extremely hard alloy and glass, magnetic materials such as ferrite, and other hard-to-grind composite materials. The discoid grindstone has 50 to 300 mm in external diameter, 0.5 to 1.0 mm in thickness, and has a diamond grain abrasive coating layer on the outer circumferential portion of the highly rigid alloy (refer to http://www.heiwa-tec.co.jp).

Furthermore, according to http://www.discousa.com/jp/products/catalog/index.html, a discoid dicing (cutting) blade having 0.1 to 0.4 mm in thickness which is fit to realize precise cutting of semiconductor integrated circuits, glass, ceramics, ferrite and the like is commercially available.

Hereinafter, a method of cutting a wire using a conventional spring manufacturing apparatus is described with reference to FIG. 19.

The conventional spring manufacturing apparatus in FIG. 19 strikes the wire W, which is pushed out of the guide 11, against the pointing tool 21 to helically wind the wire W, and cuts the wire W with the cutting tool 23 which is slidable in vertical directions and the mandrel 24 which provides shear force to the wire W in cooperation with the cutting tool 23.

Next described with reference to FIGS. 20 to 26A and 26B is a processing method for flattening both ends of a spring by a conventional grinding machine.

As mentioned above, when a spring is manufactured by a conventional spring manufacturing apparatus, since the end portion 5*a* of the wire W helically wound is cut off in the radial direction as shown in FIGS. 23A and 23B, the surfaces of both end portions of the spring do not become flat.

Therefore, both end portions of the spring 5 are ground to be flat surfaces in a manner that the spring is sandwiched between the rotating grindstones 131 as shown in FIGS. 20 to 22.

FIGS. 24A and 24B show the shape of spring 5 in which the circumferences of the end portions are ideally ground. The end portions of the spring have ultra-thin portions W1 which are formed at the tip of the wire W when ground. In order to prevent the ultra-thin portions W1 from snapping and falling at the time of use, the ultra-thin portions W1 are cut off as shown in FIGS. 25A and 25B after the grinding process. It would be ideal that a grinding amount of the end portions is about the same size as the wire diameter as shown in FIGS. 24A and 24B. However, if the grinding amount of the end portions becomes less than the wire diameter, as shown in FIGS. 26A and 26B it is possible to obtain a similar shape as the spring whose both end portions are cut off. In this case, the sectional area of the end portion 5*b* is slightly smaller than the sectional area of the ideal end portion 5*a* (i.e., since the spring has a larger surface of ungrounded rounded portion, the posture of the spring becomes unstable when the end portion is set vertically).

However, according to aforementioned Japanese Patent No. 2004851, there is a disadvantage in that using a laser beam causes thermal deformation on the cutting surface.

Furthermore, according to Japanese Patent No. 3854242, since extra-high-pressure jet water is emitted, safety measures on the periphery are necessary. Moreover, a disadvantage arises when the jet water that strikes the wire splashes and exerts damaging effects on the spring as a completed product and other parts of the apparatus.

Other objects and advantages besides those discussed above shall be apparent to those skilled in the art from the description of a preferred embodiment of the invention as follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

SUMMARY OF THE INVENTION

The present invention has been proposed in view of the above-described problems. The object of the invention is to realize a technique that enables cutting of a helical part and flattening the surface of the part's end portions without the use of laser beams or extra-high-pressure jet water.

Furthermore, the object of the invention is to realize a technique that can not only cuts a helical part but also easily processes the outer shape of a helical part.

In order to solve the above-described problems and achieve the objects, the invention provides an apparatus for manufacturing a helical part by feeding a wire toward a tool and pushing the wire against the tool to forcibly wind the wire, comprising a feed roller for feeding the wire toward the tool, a roller driving unit for rotatably driving the feed roller, a cutting unit, which holds a discoid grindstone rotatable and movable, for cutting the wire by the rotating discoid grindstone, and a control unit for controlling the roller driving unit and the cutting unit to move the discoid grindstone on a plane which is substantially perpendicular to a coil growing direction of the helical part and to cut the wire in a direction which is substantially perpendicular to the coil growing direction.

Furthermore, the invention provides an apparatus for manufacturing a helical part by feeding a wire toward a tool and pushing the wire against the tool to forcibly wind the wire, comprising, a feed roller for feeding the wire toward the tool, a roller driving unit for rotatably driving the feed roller, a grinding unit, which holds a discoid grindstone rotatable and movable, for processing an outer shape of the helical part by grinding the part with the rotating discoid grindstone, and a control unit for controlling the grinding unit to process the outer shape of the helical part by moving the discoid grindstone on a plane which is substantially perpendicular to a coil growing direction of the helical part.

Moreover, the invention provides a control method of a helical part manufacturing apparatus having a feed roller for feeding a wire toward a tool, a roller driving unit for rotatably driving the feed roller, and at least one cutting unit, which rotatably and movably holds a discoid grindstone having a thickness equal to or smaller than a diameter of the wire, for cutting the wire by the rotating discoid grindstone, the helical part manufacturing apparatus being provided for manufacturing a helical part by feeding the wire toward the tool by the feed roller and pushing the wire against the tool to forcibly wind the wire, the method comprising the step of controlling the roller driving unit and the cutting unit to move the discoid grindstone on a plane which is substantially perpendicular to a coil growing direction of the helical part and to cut the wire in a direction which is substantially perpendicular to the coil growing direction.

Furthermore, the invention provides a control method of a helical part manufacturing apparatus having a feed roller for feeding a wire toward a tool, a roller driving unit for rotatably driving the feed roller, and at least one grinding unit, which rotatably and movably holds a discoid grindstone having a thickness equal to or smaller than a diameter of the wire, for processing an outer shape of the helical part by grinding the part with the rotating discoid grindstone, the helical part manufacturing apparatus being provided for manufacturing a helical part by feeding the wire toward the tool by the feed roller and pushing the wire against the tool to forcibly wind the wire, the method comprising the step of controlling the grinding unit to process the outer shape of the helical part by moving the discoid grindstone on a plane which is substantially perpendicular to a coil growing direction of the helical part.

According to the invention, it is possible to cut a helical part and flatten the surface of the part's end portions without the use of laser beams or jet water as cutting unit.

Furthermore, the invention enables not only cutting of a helical part but also easily processing the outer shape of a helical part.

By virtue of the above features, post-processing utilizing a grinding machine becomes unnecessary and the production efficiency can be increased. Furthermore, since large-sized apparatuses for irradiating laser beams or emitting jet water are no longer necessary and the mandrel and the like becomes unnecessary, a spring manufacturing apparatus can be configured at low cost.

Other objects and advantages besides those discussed above shall be apparent to those skilled in the art from the description of the preferred embodiments of the invention as follows. In the description, reference is made to accompanying drawings, which form a part thereof, and which illustrate an example of the invention. Such example, however, is not exhaustive of the various embodiments of the invention, and therefore reference should be made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1 is a perspective view showing an external appearance of a helical part manufacturing apparatus according to the first embodiment of the present invention, where a discoid grindstone of a grindstone tool unit can be seen through.

FIGS. 9A to 9C are respectively a front elevation, a side elevation, and a cross-section showing an outer shape of a helical part manufactured by the manufacturing apparatus according to the first embodiment.

FIG. 11 is a perspective view showing an external appearance of a helical part manufacturing apparatus according to the second embodiment of the present invention, where a discoid grindstone of a grindstone tool unit can be seen through.

FIG. 15 is a perspective view showing an external appearance of a helical part manufacturing apparatus according to the third embodiment of the present invention, where a discoid grindstone of a grindstone tool unit can be seen through.

FIG. 27A is a front perspective view showing an external appearance of a helical part manufacturing apparatus according to the fourth embodiment of the present invention, where a discoid grindstone of a grindstone tool unit can be seen through.

FIG. 27B is a rear perspective view showing an external appearance of a helical part manufacturing apparatus according to the fourth embodiment of the present invention, where a discoid grindstone of a grindstone tool unit can be seen through.

DESCRIPTION OF THE EMBODIMENTS

Preferred embodiments of the present invention will now be described in detail in accordance with the accompanying drawings.

While the following embodiments are provided as an example that realizes the present invention, it is to be understood that the invention is applicable to correction or modification of the following embodiments without departing from the spirit of the invention.

In the following embodiments, a "helical part" or "helicoid" includes spring shape members such as coil springs, as well as antennas produced by helically winding a wire (see FIGS. 9A to 9C).

First Embodiment

Figure 1:
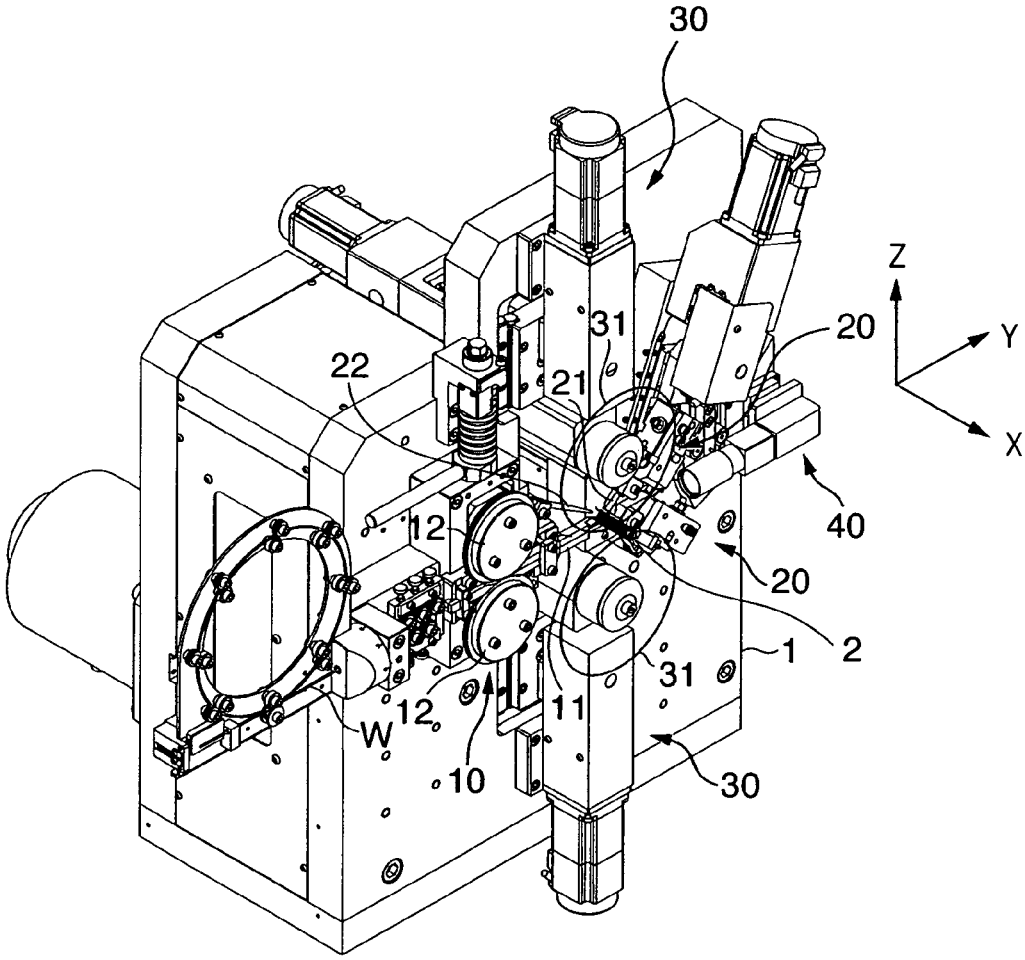
Figure 2:
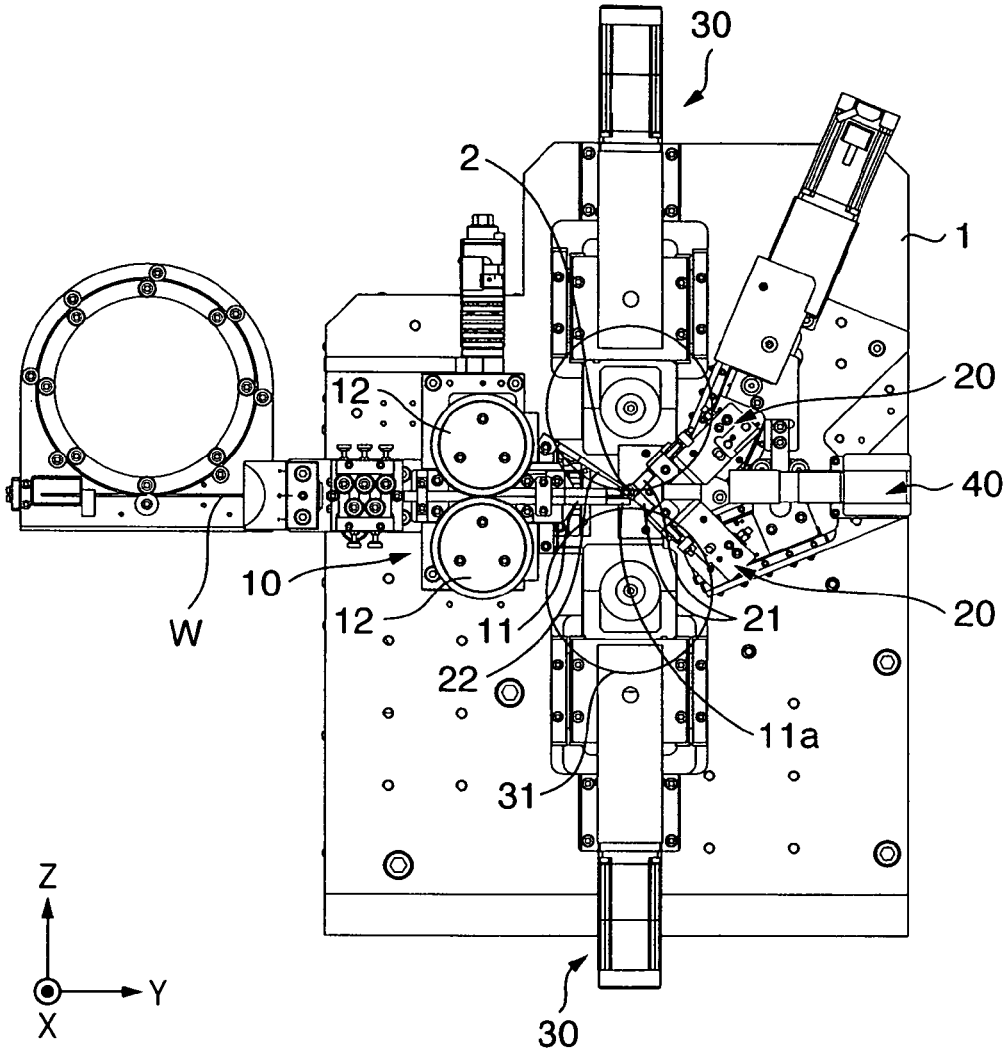
FIG. 2 is a front elevation of FIG. 1.

FIG. 1 is a perspective view showing an external appearance of a helical part manufacturing apparatus according to the first embodiment of the present invention. In the drawing, a discoid grindstone of a grindstone tool unit can be seen through. FIG. 2 is a front elevation of FIG. 1.

As an example of the helical part manufacturing apparatus, hereinafter a coil spring manufacturing apparatus is described.

As shown in FIGS. 1 and 2, the helical part manufacturing apparatus according to the first embodiment (hereinafter referred to as the manufacturing apparatus) comprises: a wire feeding unit 10 which feeds a wire W to a forming space (pointing tool 21) above a forming table 1, two tool units 20 which are pushed against the wire W fed from the wire feeding unit 10 for forcibly bending and helically winding the wire W, grindstone tool units 30 serving as cutting unit for cutting the wire W by an ultra-thin discoid grindstone 31 which rotates at high speed, and a measurement unit 40 which measures a coil length and an external diameter of the discoid grindstone 31.

The wire feeding unit 10 comprises a guide 11 which guides the wire W from a wire supplying source (not shown) to the forming space, and a pair of vertically-arranged feed rollers 12 which tightly grip the wire W in the mid-flow of the guide 11 and feed the wire W to the forming space.

One of the feed rollers 12 (the bottom one) is rotated by roller driving unit such as a wire feeding motor (see FIG. 4), and the other feed rollers 12 (the top one) is driven by the foregoing roller through an array of gears or the like. The rotation of these feed rollers 12 conveys the wire W in the wire feeding direction (Y-axis direction) along a wire feeding groove (not shown) provided within the guide 11, and pushes the wire W out of the end portion 11*a* of the guide 11 toward the forming space.

Each of the tool units 20 comprises a pointing tool 21 which is arranged opposite to the end portion 11*a* of the guide 11. While the wire W is pushed out by the feed rollers 12, the wire W is pushed against each pointing tool 21, thereby being forcibly bent and helically wound to form a helicoid 2.

The end portion of each pointing tool 21 has a groove. By finely adjusting the angle of the groove with respect to the wire feeding direction, the wire W is wound and grown on the surface (Y-Z plane) that is substantially perpendicular to the coil growing direction (X-axis direction). Moreover, each pointing tool 21 is reciprocally movable in the tool axis direction by a pointing tool driving motor (see the drawings). By controlling the pointing tool driving motor and adjusting the distance between the end portion of each pointing tool 21 and the end portion 11*a* of the guide 11 (to be exact, the center of the coil diameter), it is possible to form a coil spring having a desired coil diameter (which means an external diameter or mean diameter of the coil). Furthermore, by adjusting the feeding amount of wire W with the feed rollers 12, the coiling number of the helicoid is determined.

Normally two pointing tools 21 are provided. The intersecting point of the axial lines that extend from respective tool axes virtually matches the center of the coil diameter. Each of the pointing tools is arranged at an angle of 90° with respect to the center of the coil diameter. By adjusting the position of the intersecting point of the axial lines that extend from respective tool axes upward (Z-axis direction) from the wire feeding position, it is possible to form a clockwise coil spring. On the other hand, by adjusting the position of the intersecting point downward, it is possible to form a counterclockwise coil spring.

Provided adjacent to the pointing tool 21 is a pitch tool 22 which sets a coil pitch by being struck against the wire W which is being helically wound. By a pitch tool driving motor (see FIG. 4), the pitch tool 22 is movable substantially in parallel with the coil growing direction, and is rotatable at a predetermined angle on the rotation axis that is substantially parallel with the coil growing direction. By controlling the pitch tool driving motor (FIG. 4), it is possible to form a coil spring having a desired pitch.

If the pitch tool 22 does not intermediate when coiling the wire W, the coil spring will have no space between the wound coil portions. If the pitch tool 22 intermediates, a compression coil spring where the coil portions are spaced at a desired pitch is formed.

The measurement unit 40 is arranged on the tool unit side (the side opposite to the feed rollers 12 with respect to the forming space) on the forming table 1. The measurement unit 40 measures a coil length based on image data, which is obtained by sensing an image of the sequentially growing the helicoid with a CCD camera or the like. The measurement unit 40 also measures an external diameter of the discoid grindstone which will be described later.

Figure 6A:
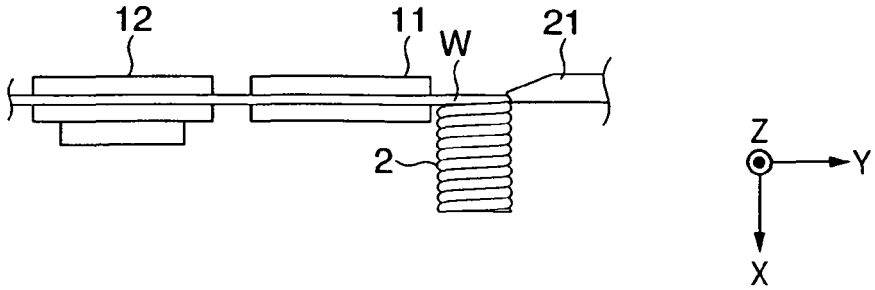
FIGS. 6A to 6C are explanatory views of the cutting process 1.
Figure 6B:
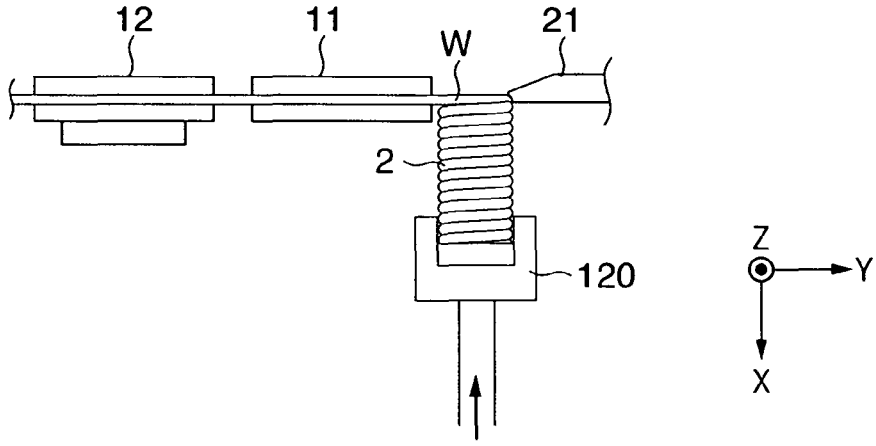
Figure 6C:
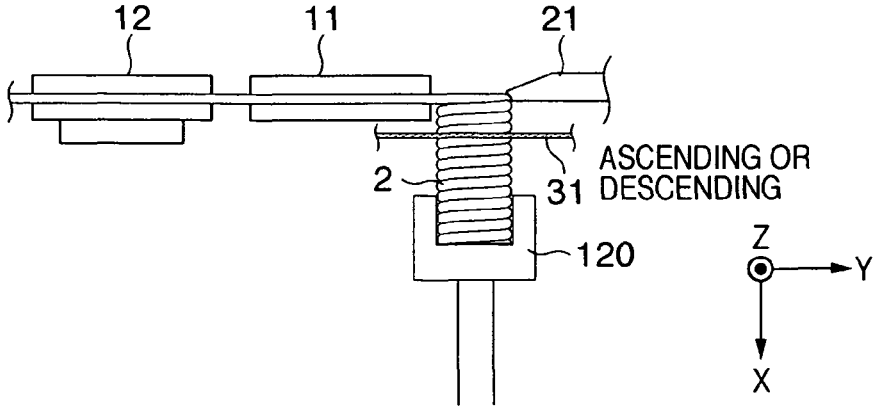

Note that a chuck arranged opposite to the forming table for holding the free end of the helicoid 2 which will be described later in FIGS. 6A to 6C is omitted in the drawings.

<Grindstone Tool Unit>

Figure 3A:
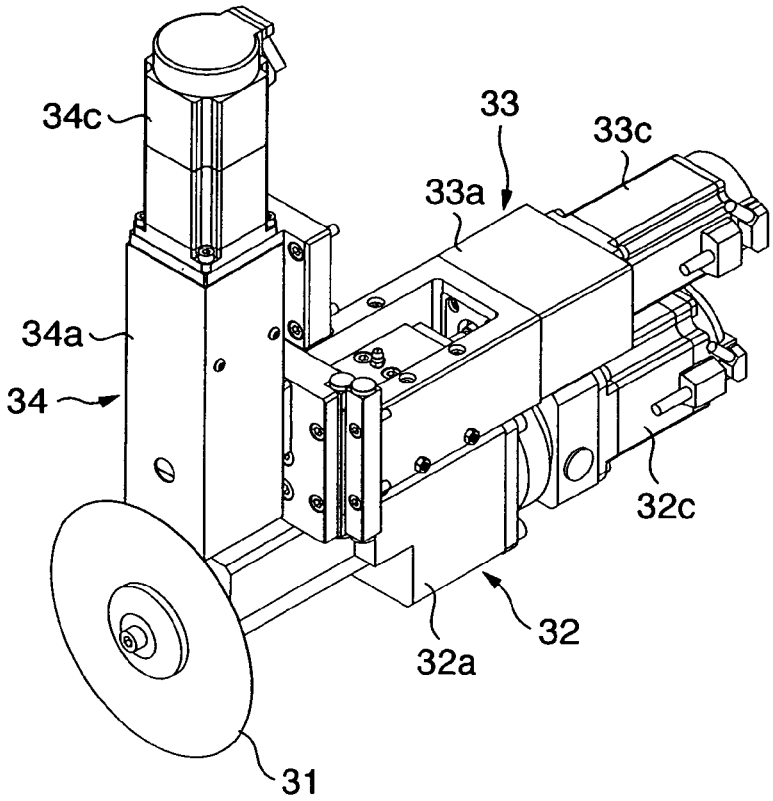
FIGS. 3A and 3B are respectively a perspective view and a sectional side view of the grindstone tool unit.
Figure 3B:
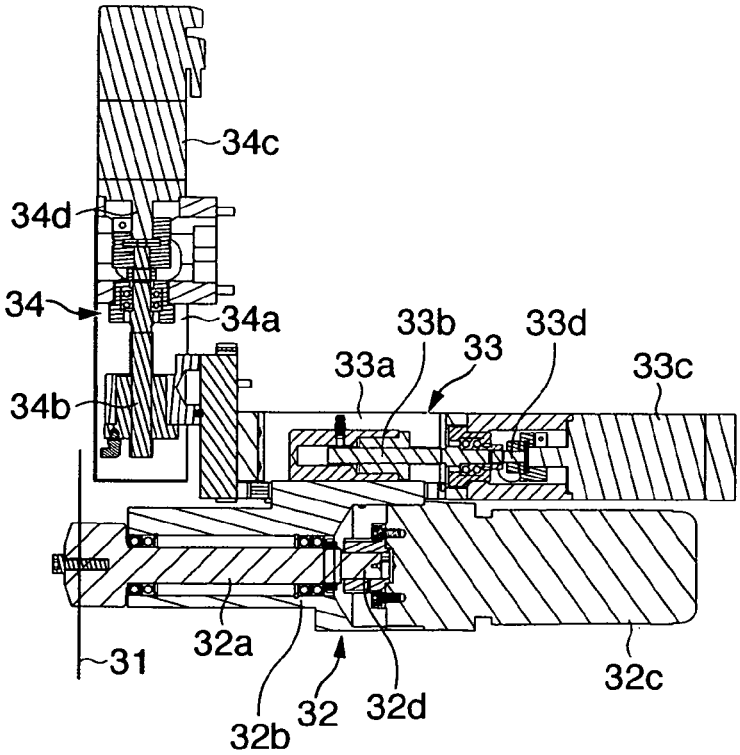

FIGS. 3A and 3B are respectively a perspective view and a sectional side view of a grindstone tool unit.

The grindstone tool units 30 are arranged in a manner that the discoid grindstones 31 face each other along the vertical direction (Z-axis direction) in the forming space. Note that at least one grindstone tool unit 30 may be provided, either on the top or bottom.

The grindstone tool unit 30 supports the discoid grindstone 31 in a manner that the discoid grindstone 31 is rotatable in a state parallel with the forming table 1 (in parallel with Y-Z plane). While rotating the discoid grindstone 31, the grindstone tool unit 30 is movable at least in the coil growing direction (X-axis direction) and movable along the surface substantially perpendicular to the coil growing direction (direction parallel with Y-Z plane).

The grindstone tool unit 30 comprises: a rotation driving unit 32 which rotates the discoid grindstone 31, a X-direction driving unit 33 which drives the rotation driving unit 32 in the X-axis direction, and a Z-direction driving unit 34 which drives the rotation driving unit 32 and X-direction driving unit 33 in the Z-axis direction.

The rotation driving unit 32 comprises: a rotation axle 32*a* whose one end is attached to the discoid grindstone 31, a rotation axle housing 32*b* which supports the rotation axle 32*a* so that the axle 32*a* is rotatable freely, and a rotation driving motor 32*c* which is connected to an output axle 32*d* attached to the other end of the rotation axle 32*a* and which is supported by the rotation axle housing 32*b*.

The X-direction driving unit 33 comprises: a X-direction driving axle housing 33*a* connected to the rotation axle housing 32*b*, a X-direction driving axle 33*b* which is supported by the X-direction driving axle housing 33*a* so as to be slidable in the X-axis direction, and a X-direction driving motor 33*c* which is connected to an output axle 33*d* attached to the X-direction driving axle 33*b* via a ball screw mechanism or the like and which drives the X-direction driving axle 33*b* in sliding motion in the X-axis direction. The X-direction driving motor 33*c* is supported by the X-direction driving axle housing 33*a*.

Furthermore, the Z-direction driving unit 34 comprises: a Z-direction driving axle housing 34*a* mounted to the forming table, a Z-direction driving axle 34*b* which is supported by the Z-direction driving axle housing 34*a* so as to be slidable in the Z-axis direction and is connected to the X-direction driving axle housing 33*a*, and a Z-direction driving motor 34*c* which is connected to an output axle 34*d* attached to the Z-direction driving axle 34*b* via a ball screw mechanism or the like and which drives the Z-direction driving axle 34*b* in sliding motion in the Z-axis direction. The Z-direction driving motor 34*c* is supported by the Z-direction driving axle housing 34*a*.

Note that the discoid grindstone 31 is arranged at a position away from the pointing tool 21 in the X-axis direction on the forming table 1 so as not to interfere with the pointing tool 21. Also, the stroke range of the discoid grindstone 31 in the Z-axis direction is so set that it does not interfere with the pointing tool.

<Block Configuration>

Figure 4:
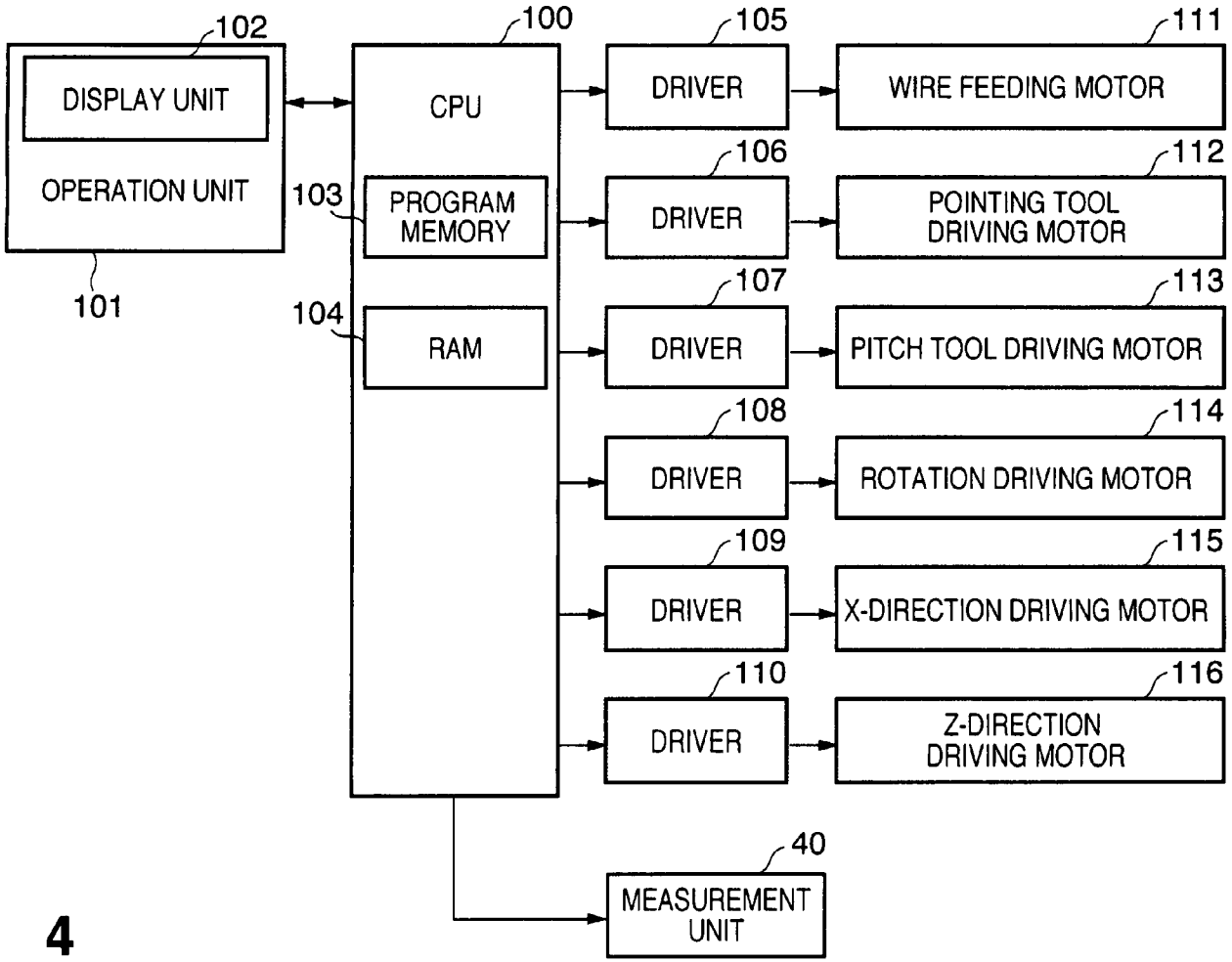
FIG. 4 is a block diagram of a control system of the helical part manufacturing apparatus according to the embodiment of the present invention.

FIG. 4 is a block diagram of a control system of the helical part manufacturing apparatus according to the embodiment of the present invention. A CPU 100 controls the overall apparatus. An operation unit 101 gives instructions for operating or stopping the apparatus and for setting various parameters such as a size of a helical part. The operation unit 101 includes a display unit 102 for displaying the operation contents and apparatus status. Note that the CPU 100 includes program memory 103 for storing an operation procedure, and RAM 104 for being used as a working area. Drivers 105 to 110 are provided for the following motors. A wire feeding motor 111, e.g., a servomotor, rotates the feed roller 12. A pointing tool driving motor 112, e.g., a servomotor, drives the pointing tool 21 in the tool axis direction. A pitch tool driving motor 113, e.g., a servomotor, rotates the pitch tool 22. A rotation driving motor 114, e.g., a servomotor, rotates the discoid grindstone 31 at predetermined rotating speed. X-direction driving motor 115 and Z-direction driving motor 116 respectively move the grindstone tool unit 30 in the X-axis and Z-axis directions. In other words, the grindstone tool unit 30 is moved at least in parallel with the Y-Z plane, which is substantially perpendicular to the coil growing direction, to cut the wire W substantially perpendicular to the coil growing direction.

Note in the above-described configuration, a Y-direction driving motor may be provided to the grindstone tool unit 30 to move the discoid grindstone 31 in the Y-axis direction.

The measurement unit 40 and chuck 120 which will be described later are electrically connected to the CPU 100 as shown in FIG. 4 so as to be controlled by the CPU 100.

<Cutting Process 1>

Next described with reference to FIGS. 1 to 4 and FIGS. 5 to 6A-6C is a part manufacturing procedure including a wire cutting process 1 using the aforementioned manufacturing apparatus.

The cutting process 1 is a procedure for cutting the wire W, which has been grown to a predetermined coil length, while stopping the feeding of the wire W.

Figure 5:
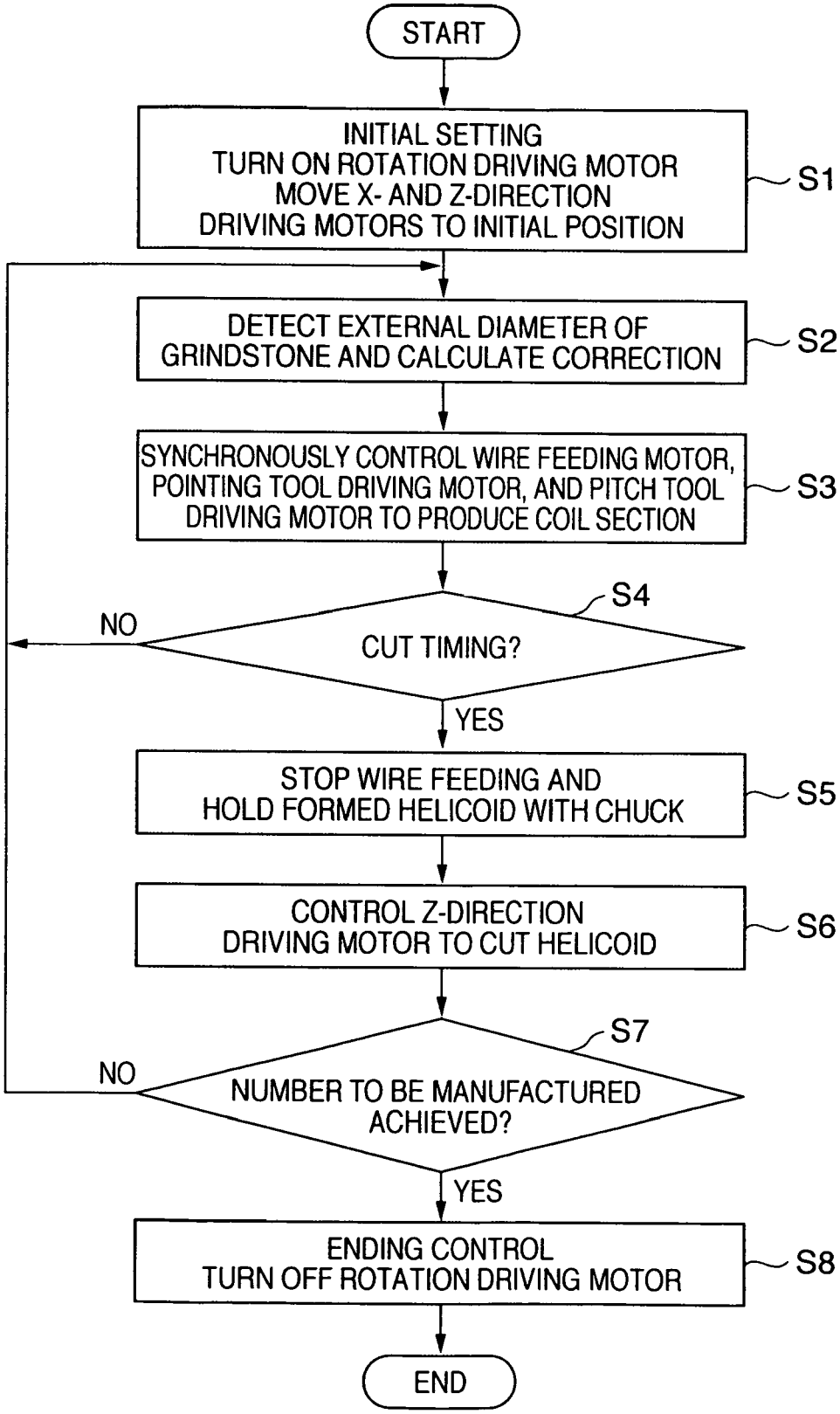
FIG. 5 is a flowchart describing a part manufacturing procedure that includes a wire cutting process 1 utilizing the manufacturing apparatus according to the first embodiment.

FIG. 5 is a flowchart describing a part manufacturing procedure that includes the wire cutting process 1 utilizing the manufacturing apparatus according to the first embodiment. FIGS. 6A to 6C are explanatory views of the cutting process 1. For ease of explanation, the following description provides a case where the pointing tool 21 manufactures a coil spring having a fixed coil diameter, i.e., a uniform coil diameter.

When the process shown in FIG. 5 starts, in step S1 a user sets various parameters as initial setting, e.g., a thickness of the wire (diameter), a coil length, and the number of products to be manufactured. The CPU 100 starts rotation of the discoid grindstone 31, and drives the X-direction and Z-direction driving motors to move the discoid grindstone 31 to the initial position. Herein, the discoid grindstone is spun at about 2500 to 3000 rpm. Among discoid grindstones having an external diameter from 50 to 300 mm and a thickness from 0.1 to 5.0 mm, the one having a thickness equal to or smaller than the diameter of the wire W (e.g., 0.1 to 20 mm) is selected for the discoid grindstone 31. For instance, a diamond cutting wheel or fine cutting wheel produced by Heiwa Technica Co. Ltd. (http://www.heiwa-tec.co.jp/), a dicing blade produced by Disco Co. Ltd. (http://www.discousa.com/jp/products/catalog/index.html), or a cutting diamond CBN wheel produced by Keihin Kogyosho Co. Ltd. can be used.

In step S2, the CPU 100 detects the external diameter of the discoid grindstone 31 using the measurement unit 40. Based on the variation value (amount of grinding abrasion) of the external diameter of the discoid grindstone 31 which has been calculated based on the detection result, the CPU 100 calculates a correction of a motion distance of the discoid grindstone 31.

In step S3, the CPU 100 synchronously controls the wire feeding motor 111, pointing tool driving motor 112, and pitch tool driving motor 113 based on the parameters set in step S1 and the corrected motion distance given in step S2, thereby helically winding the wire W at desired pitch as shown in FIG. 6A.

In step S4, the CPU 100 determines whether or not it is time for cutting. The cut timing is determined by detecting the coil length with the measurement unit 40 and determining whether or not the detected coil length has reached the set value given in step S1. The cut timing may also be determined by whether or not the length of wire W equivalent to the coil length given in step S1 has been fed. Until the wire cut timing is determined, the wire feeding motor 111, pointing tool driving motor 112, and pitch tool driving motor 113 are continuously driven as programmed.

When the cut timing is determined in step S4 (YES in step S4), the control proceeds to step S5. The CPU 100 temporarily stops the wire feeding motor 111 and moves the chuck 120 forward, which is arranged opposite to the forming table as shown in FIG. 6B, to hold the free end of the formed helicoid 2.

In step S6, the CPU 100 controls the Z-direction driving motor as shown in FIG. 6C to cut the wire from the outer circumference of the helicoid 2 using the discoid grindstone 31, and then moves the grindstone 31 to the initial position.

In step S7, the CPU 100 repeats the control from steps S2 to S6 until the number of helicoids reaches the number to be manufactured given in step S1. When it reaches the number to be manufactured, the program ending control is executed in step S8 and rotation of the discoid grindstone 31 is stopped.

According to the foregoing procedure, when the wire cutting is completed by the discoid grindstone 31, the leading edge of the helical part to be manufactured next is simultaneously formed.

By synchronously controlling the descending motion of the discoid grindstone 31 of the upper grindstone tool unit 30 and the ascending motion of the discoid grindstone 31 of the lower grindstone tool unit 30 so as to achieve a substantially equal motion distance, the helical part can be cut while being clamped by the upper and lower discoid grindstones 31. Therefore, it is possible to avoid flexure of the helical part and cut the wire without using the aforementioned chuck 120.

<Cutting Process 2>

Next described with reference to FIGS. 1 to 4 and FIG. 7 to 8A-8B is a part manufacturing procedure including a wire cutting process 2 using the aforementioned manufacturing apparatus.

The cutting process 2 is a procedure of cutting the wire W while feeding and growing the wire W into a helical shape.

Figure 7:
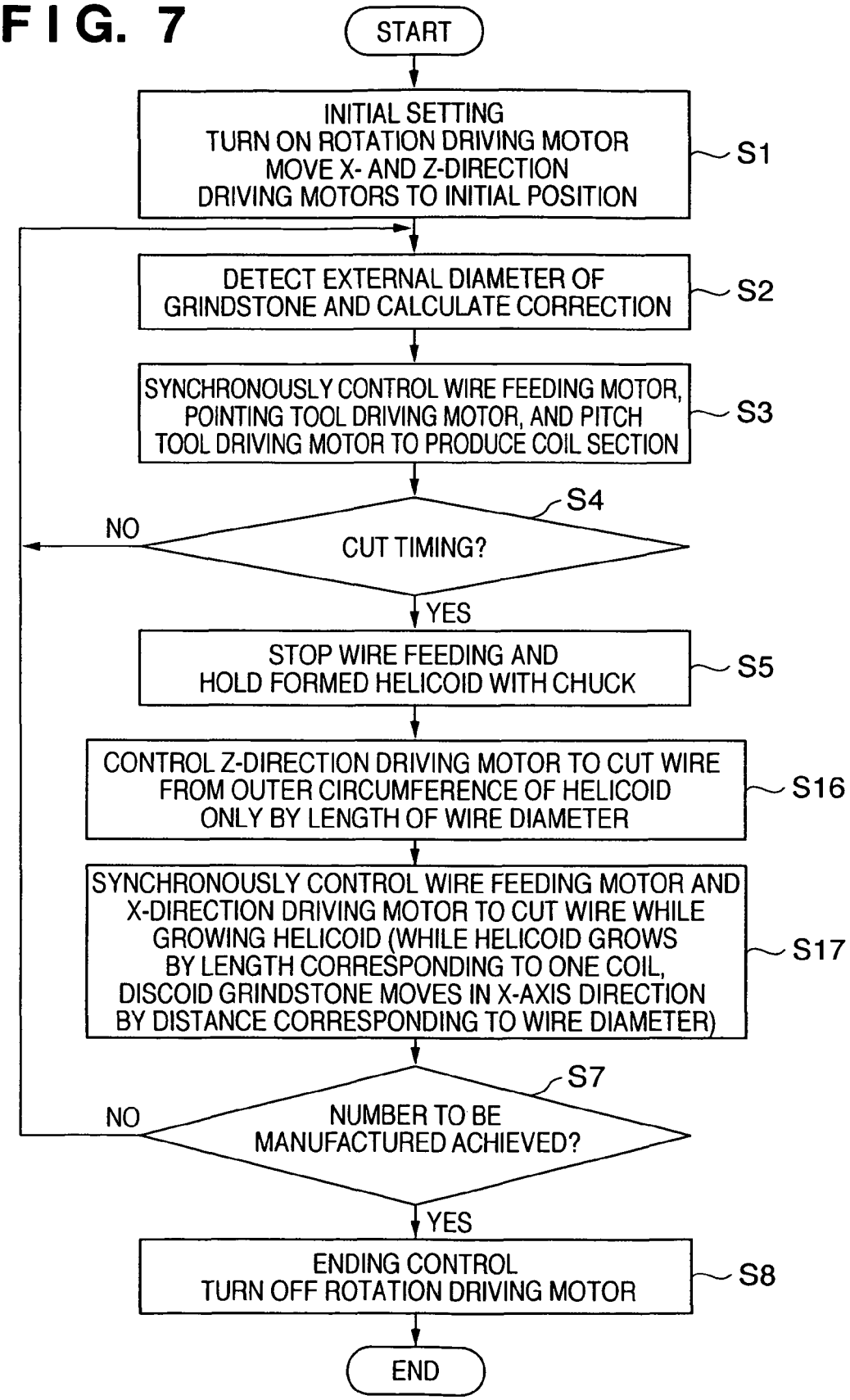
FIG. 7 is a flowchart describing a part manufacturing procedure that includes a wire cutting process 2 utilizing the manufacturing apparatus according to the embodiment.
Figure 8A:
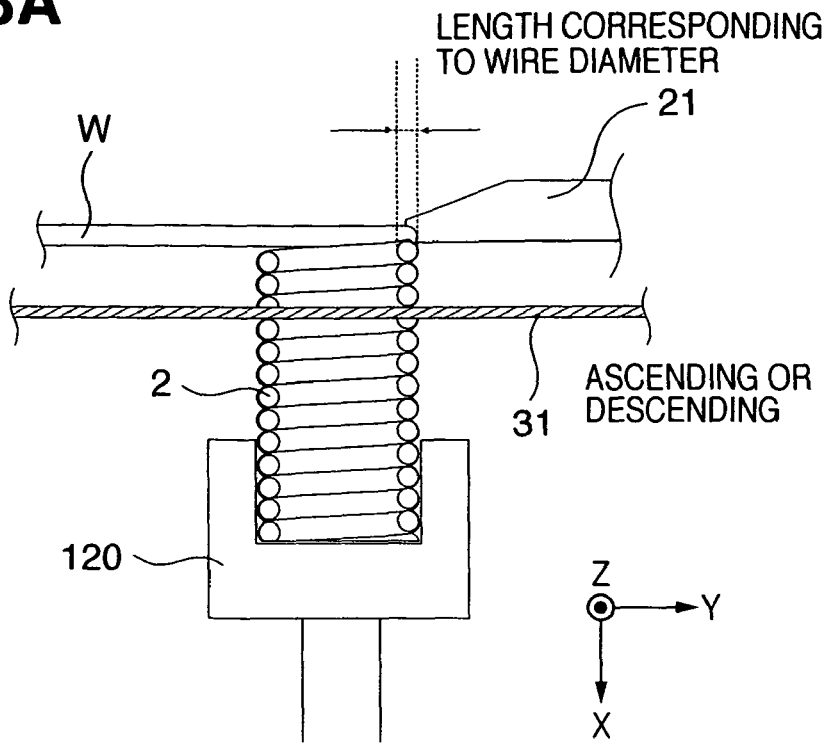
FIGS. 8A and 8B are explanatory views of the cutting process 2.
Figure 8B:
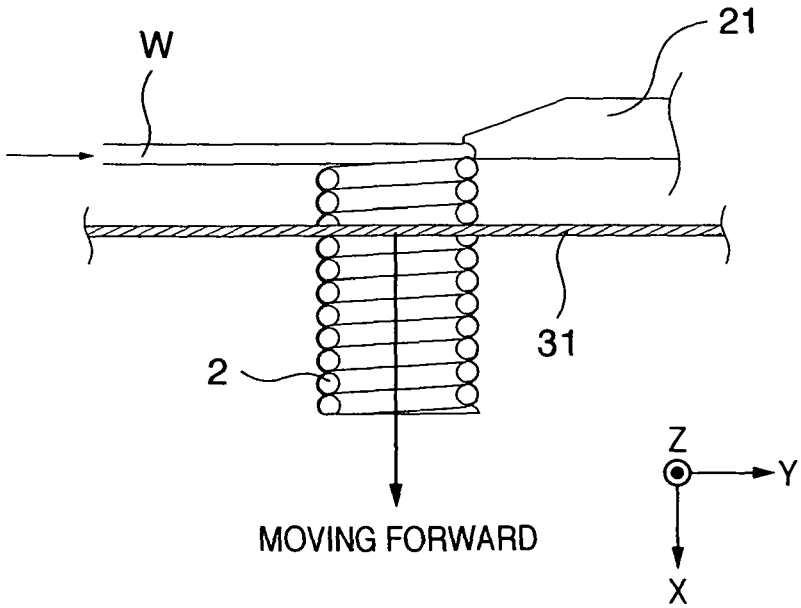

FIG. 7 is a flowchart describing a part manufacturing procedure that includes the wire cutting process 2 utilizing the manufacturing apparatus according to the embodiment. FIGS. 8A and 8B are explanatory views of the cutting process 2. Similar to the above-described cutting process 1, the following description provides, for ease of explanation, a case where a coil spring having a uniform coil diameter is manufactured.

In FIG. 7, steps S1 to S5 and S7 to S8 are similar to that of the above-described cutting process 1. What is different from the process 1 are steps S16 and S17 which follow step S5. In step S16, the CPU 100 controls the Z-direction driving motor 116 as shown in FIG. 8A to cut the wire from the outer circumference of the helicoid 2 using the discoid grindstone 31 only by the length corresponding to the wire diameter.

In step S17, the CPU 100 synchronously controls the wire feeding motor 111 and the X-direction driving motor 115 to cut the wire while growing the helicoid. FIG. 8B shows a condition of cutting the while the helicoid 2 is growing. While the helicoid 2 grows by a length corresponding to one coil (while the wire corresponding to one coil is fed), the discoid grindstone 31 moves in the X direction (coil growing direction) by a distance corresponding to the wire diameter. Note that the chuck 120 is slidable on the X axis while holding the helicoid 2.

By virtue of these steps, the wire W can be cut while being fed and grown. Therefore, the manufacturing time of each part is reduced and production efficiency is increased.

According to the above-described embodiment, the end portion of a helical part can be cut and flattened at the same time without the use of laser beams or extra-high-pressure jet water. Therefore, post-processing utilizing a grinding machine becomes unnecessary and the production efficiency can be increased. Furthermore, because large apparatuses for irradiating laser beams or emitting jet water are no longer necessary and the mandrel and the like becomes unnecessary, the spring manufacturing apparatus can be configured at low cost.

Among compression coil springs, the above example is particularly effective in manufacturing a spring having a small ratio (4 or less) of external diameter to wire diameter (D/d). More specifically, when the ratio D/d is 4 or less, the internal diameter of the spring becomes small, and as a result, the mandrel intervening in the coil portion becomes small and unable to endure the cutting load, and the life of the mandrel becomes extremely short.

On the contrary, the above-described embodiment can be by far advantageous since the smaller the D/d of the spring (spring having a small external diameter), the shorter the cutting time and the smaller the ultra-thin portions at both ends of the spring. Therefore, it is possible to solve the conventional cutting problem and eliminate the cumbersome task of grinding the end surfaces that has been necessary in a case of manufacturing a spring having a small D/d, and thus possible to realize an extremely revolutionary technology.

Modification of First Embodiment

In the above-described first embodiment, the discoid grindstone 31 of the grindstone tool unit 30 is used for cutting the helicoid and grinding the end portions of the helicoid. In the modification, the grindstone tool unit 30 is adapted as grinding unit for processing the outer shape of the helical part.

Figure 10A:
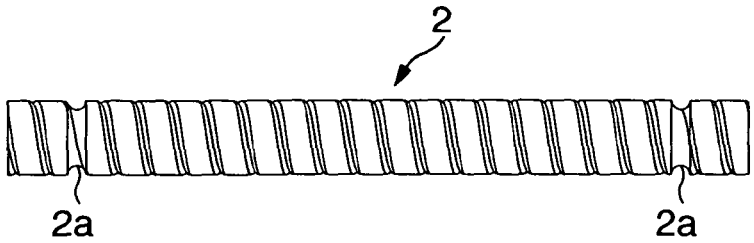
FIGS. 10A to 10C are views showing an outer shape of a helical part which is processed by the grindstone tool unit according to the embodiment.
Figure 10B:
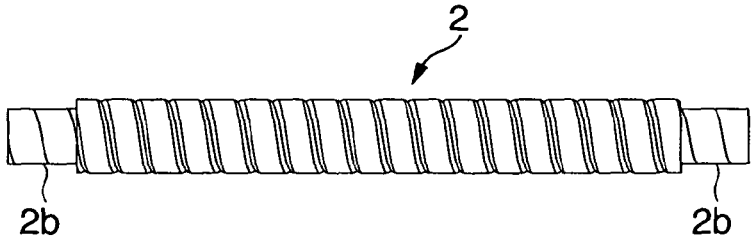
Figure 10C:
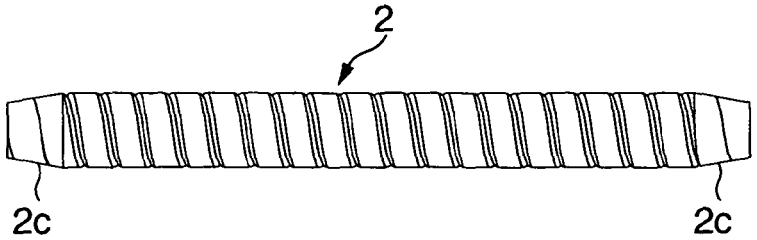

FIGS. 9A to 9C are respectively a front elevation, a side elevation, and a cross-section showing an outer shape of a helical part manufactured by the manufacturing apparatus according to the first embodiment. FIGS. 10A to 10C are views showing an outer shape of a helical part which is processed by the grindstone tool unit according to the embodiment.

The helical part 2 shown in FIGS. 9A to 9C is an antenna, which is configured by helically winding a wire having a rectangular cross-section, and is mounted to a wireless communication device such as a mobile-phone.

By controlling the operation of respective units 10 to 40 shown in FIGS. 1 to 3B with the use of the CPU 100 in FIG. 4, a wire can be helically wound by the above-described helical part manufacturing apparatus. Thereafter, a groove 2*a* can be formed on the outer circumferential surface by controlling the operation of the grindstone tool unit 30, and a tapered portion 2*c* or an uneven portion 2*b* where diameter is reduced at end portions can be formed.

Needless to say, after the outer shape of the helical part is processed, the grindstone tool unit 30 can cut the helical part and grind the end portions of the helical part as similar to the first embodiment.

According to the modification of the first embodiment, the manufacturing apparatus can not only cut a helical part but also process the outer shape of the helical part with ease.

Second Embodiment

In the above-described first embodiment, the helicoid cutting is performed using only the grindstone tool unit 30. However in the second embodiment, a helicoid cutting is performed by cooperatively operating the grindstone tool unit 30 and laser unit 50.

Figure 11:
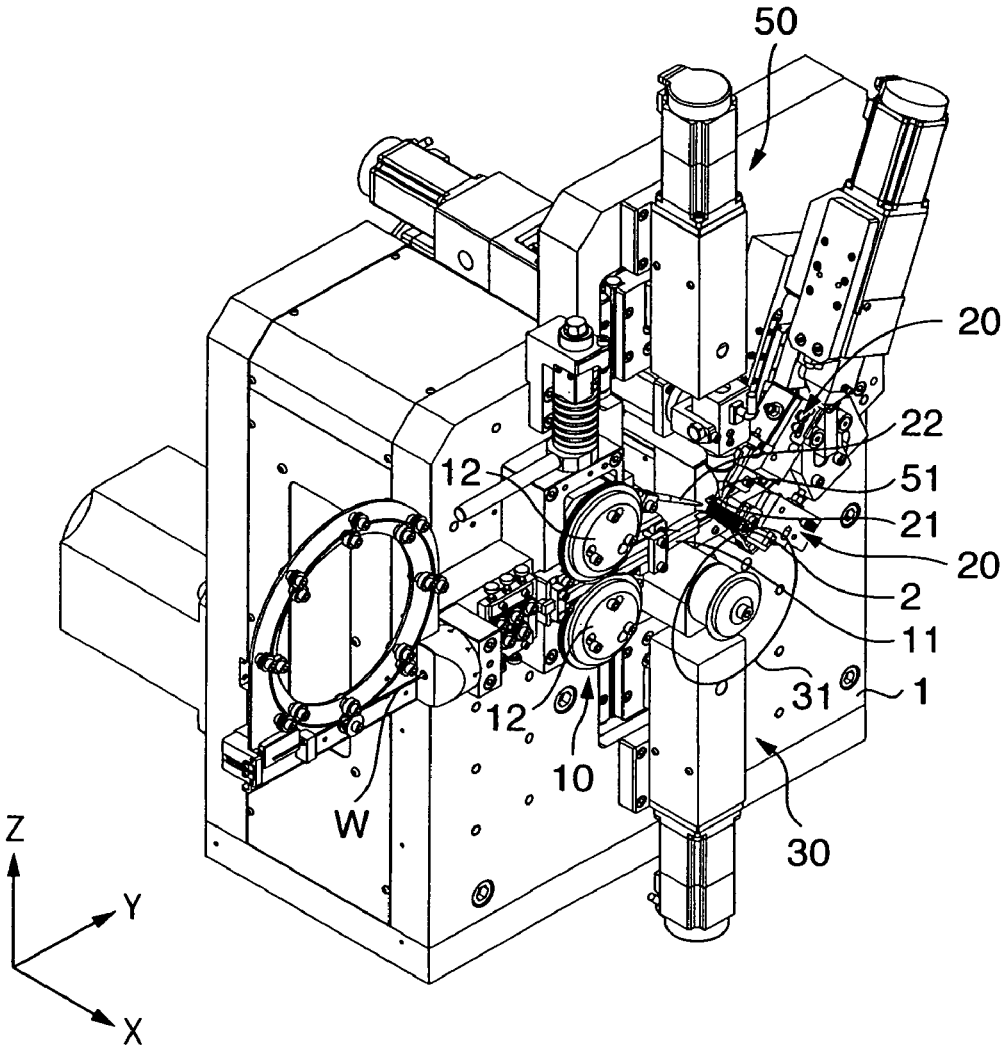
Figure 12:
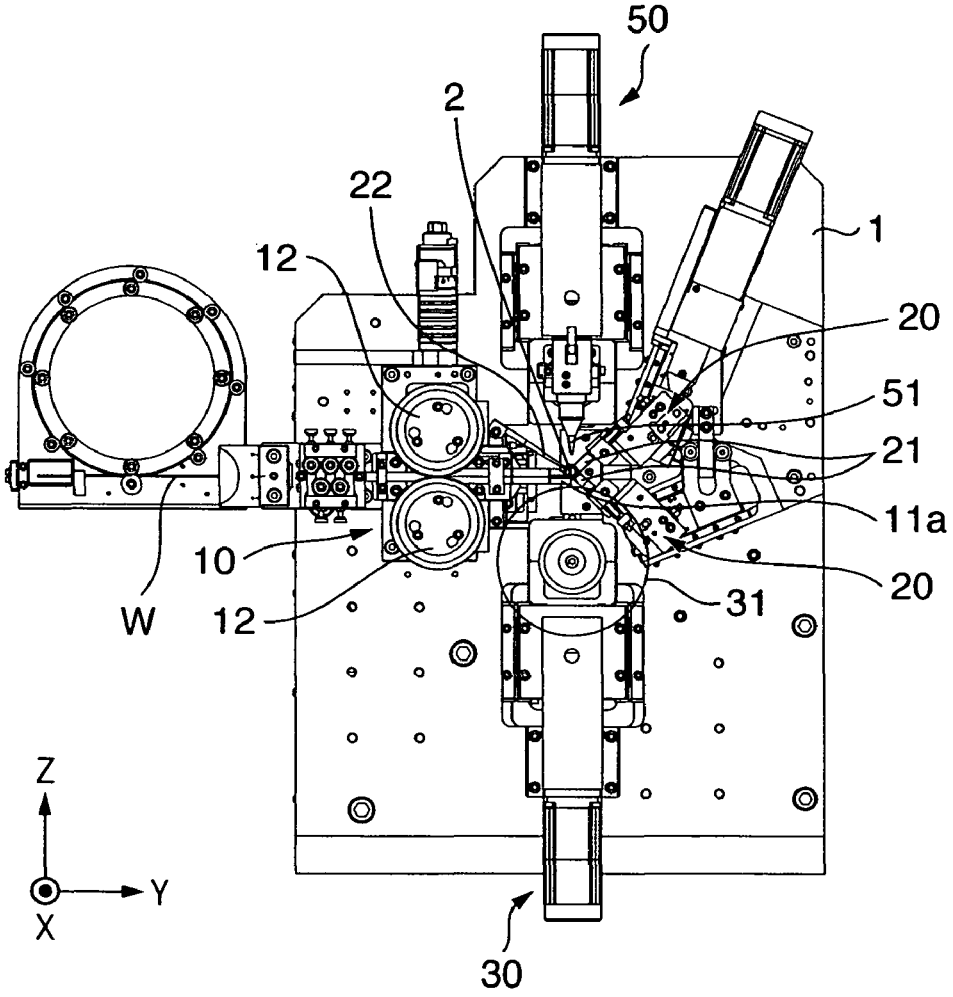
FIG. 12 is a front elevation of FIG. 11.

FIG. 11 is a perspective view showing an external appearance of a helical part manufacturing apparatus according to the second embodiment of the present invention. In the drawing, the discoid grindstone of the grindstone tool unit can be seen through. FIG. 12 is a front elevation of FIG. 11. Note that the chuck is omitted in FIGS. 11 and 12.

The configuration shown in FIGS. 11 and 12 has a laser unit 50 in place of the grindstone tool unit 30 described in the first embodiment. Note that the measurement unit 40 is omitted in the drawing. For the structure in common with that of FIG. 1, identical reference numerals are assigned and descriptions thereof are omitted. The position of the laser unit 50 may be switched with the position of the grindstone tool unit 30 provided at the bottom.

The laser unit 50 is controlled by the CPU 100 shown in FIG. 4 and, as similar to the grindstone tool unit 30, can move the laser head 51 at least in the coil growing direction (X-axis direction) and the direction along the surface substantially perpendicular to the coil growing direction (direction parallel with Y-Z plane). The laser unit 50 serves to make a cutting line on part of the cutting place of the wire W which has been helically wound.

As described in the conventional art, a helicoid cut by the grindstone tool unit 30 includes ultra-thin portions at both ends. By virtue of the laser unit 50 which is additionally provided in the second embodiment, the post-processing of removing the ultra-thin portions becomes unnecessary, because the ultra-thin portions can be removed at the same time as the wire cutting executed by the discoid grindstone 31.

<Cutting Process 3>

Next described with reference to FIGS. 4 and 11 to 14 is a part manufacturing procedure including a wire cutting process 3 using the manufacturing apparatus according to the second embodiment.

In the cutting process 3, the wire W is grown to a predetermined coil length, then the wire feeding is stopped and the laser unit 50 makes a cutting line on part of the outer circumference of the wire W before cutting the wire W. As a result, the ultra-thin portions at end portions of the helicoid 2 can be removed at the same time as the wire cutting performed by the discoid grindstone 31.

Figure 13:
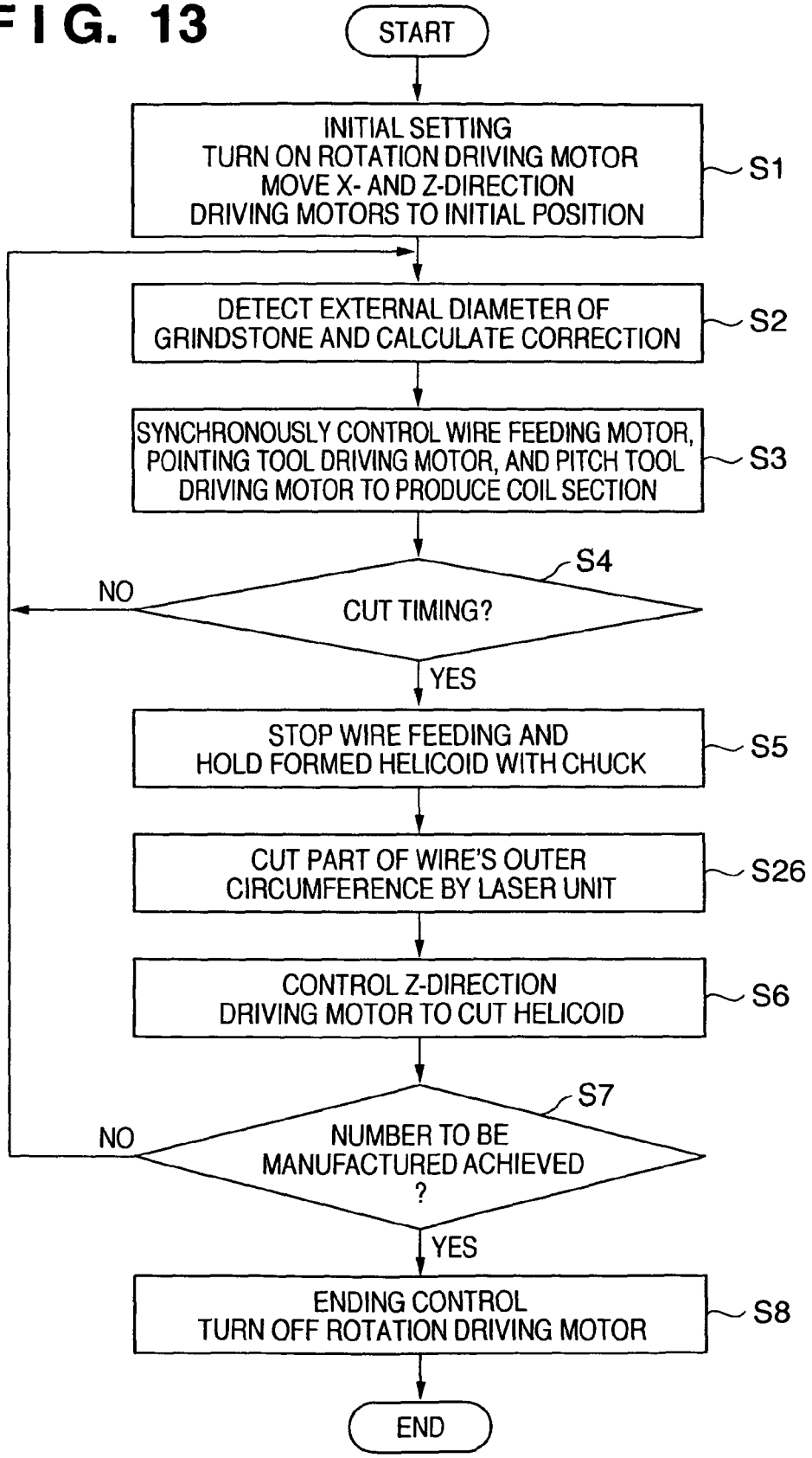
FIG. 13 is a flowchart describing a part manufacturing procedure that includes a wire cutting process 3 utilizing the manufacturing apparatus according to the second embodiment.
Figure 14:
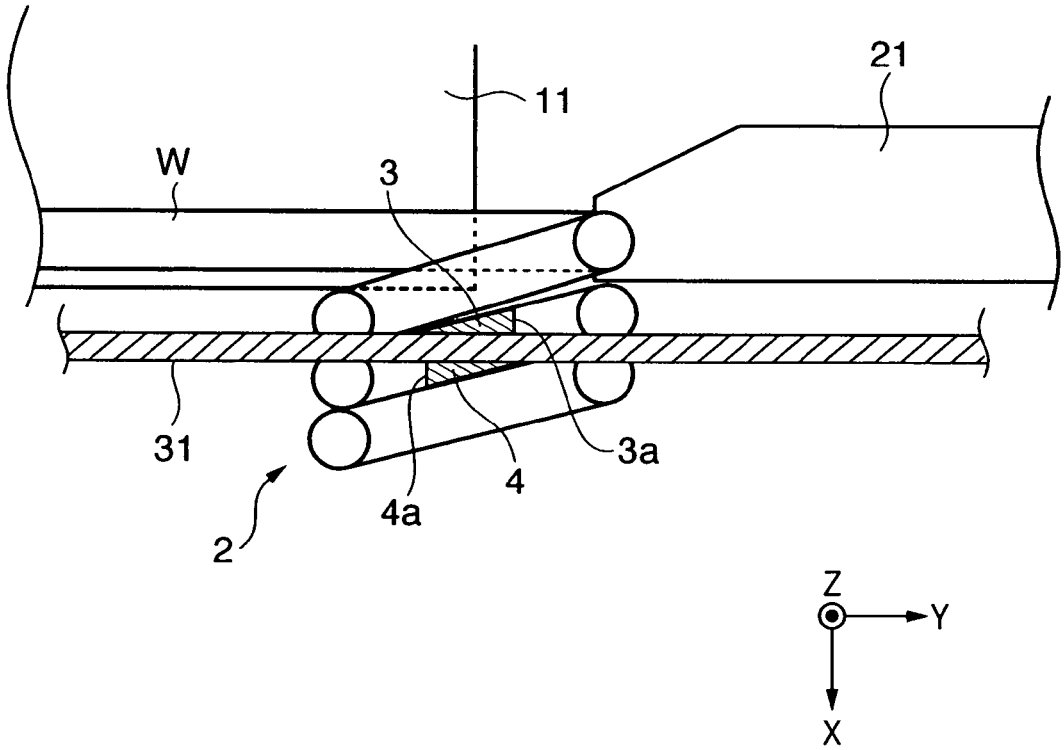
FIG. 14 is an explanatory view of the cutting process 3.

FIG. 13 is a flowchart describing a part manufacturing procedure that includes the wire cutting process 3 utilizing the manufacturing apparatus according to the second embodiment. FIG. 14 is an explanatory view of the cutting process 3. Similar to the above-described cutting processes 1 and 2, the following description provides, for ease of explanation, a case where a coil spring having a uniform coil diameter is manufactured.

In FIG. 13, steps S1 to S5 and S6 to S8 are similar to that of the above-described cutting process 1. Different processing is step S26 which follows step S5. More specifically, in step S26 the CPU 100 controls the laser unit 50 to make a cutting line on part of the outer circumference of the wire W, which corresponds to the place to be cut by the discoid grindstone 31. As shown in FIG. 14, cutting lines 3*a* and 4*a* are made in Y direction at two positions on the front and back of the outer circumference of the wire W, which will turn out to be the ultra-thin portions 3 and 4 when the wire is cut by the discoid grindstone 31.

Thereafter in step S6, the CPU 100 controls the Z-direction driving motor 116 in a manner that the discoid grindstone 31 moves across the uncut part of the cutting lines 3*a* and 4*a* at the aforementioned two positions to cut the wire, thereby removing the ultra-thin end portions of the wire W.

According to the second embodiment, the conventional operation of removing the ultra-thin portions using a file or the like becomes unnecessary, and therefore production efficiency can be increased.

Third Embodiment

In the above-described first and second embodiments, the discoid grindstones 31 of the grindstone tool units 30 are arranged vertically (in the Z direction) so that the moving direction of the discoid grindstones 31 is orthogonal to the wire feeding direction (Y direction). However, in the third embodiment, a discoid grindstone 81 of the grindstone tool unit 80 is arranged in a manner that the discoid grindstone 81 moves along the wire feeding direction and is positioned opposite to the wire feeding direction. More specifically, the discoid grindstone 81 is arranged at the position where the pointing tool 21 is arranged in the first embodiment, i.e., a position along the wire feeding direction and opposite to the guide 11.

Figure 15:
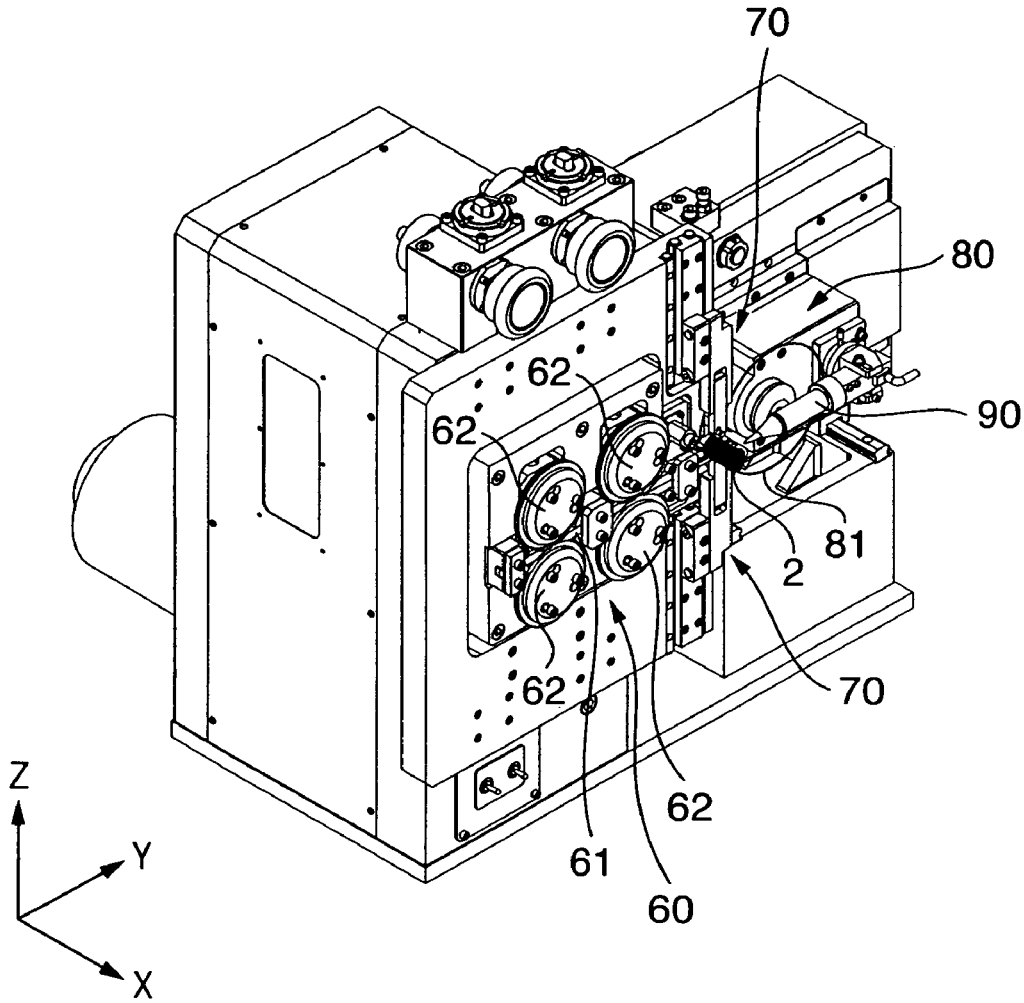
Figure 16:
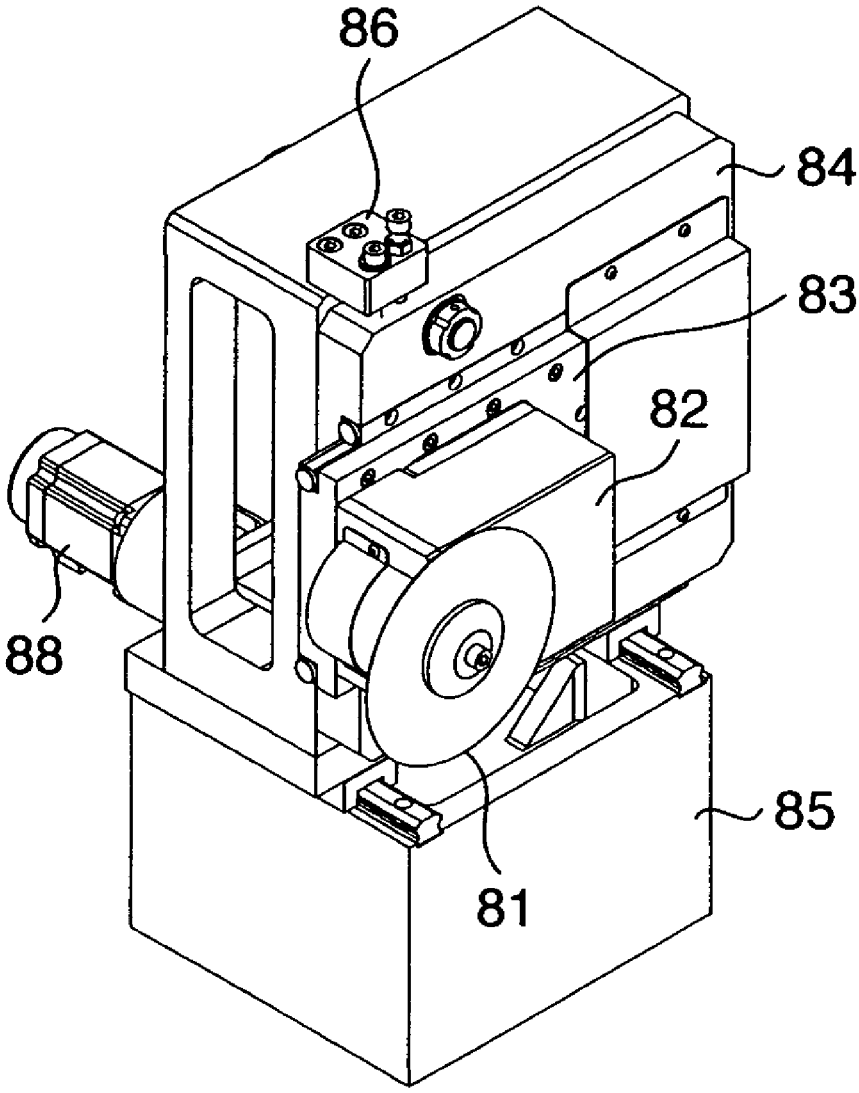
FIG. 16 is a perspective view showing an external appearance of the grindstone tool unit according to the third embodiment.
Figure 17B:
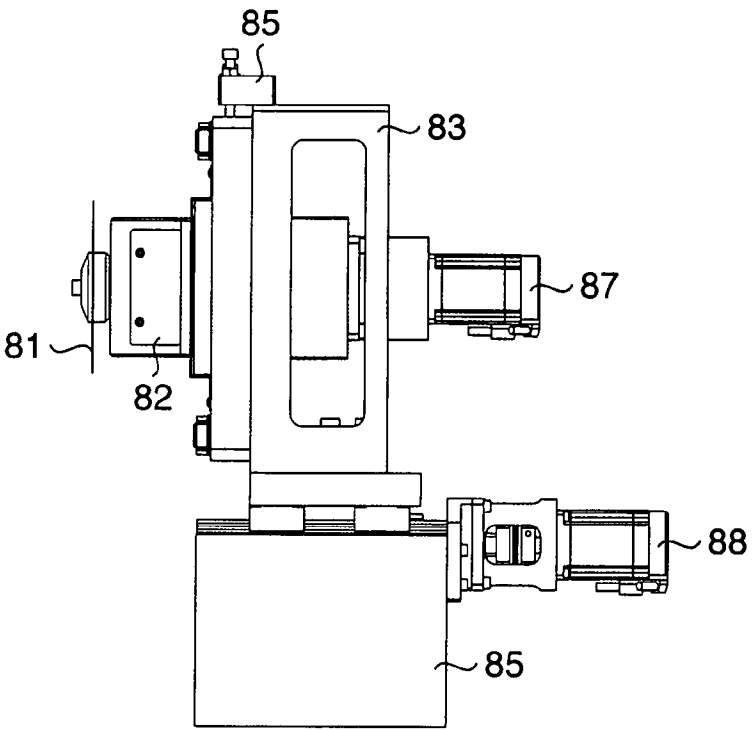
FIGS. 17A and 17B are respectively a front elevation and a side elevation of the grindstone tool unit shown in FIG. 16.
Figure 17A:
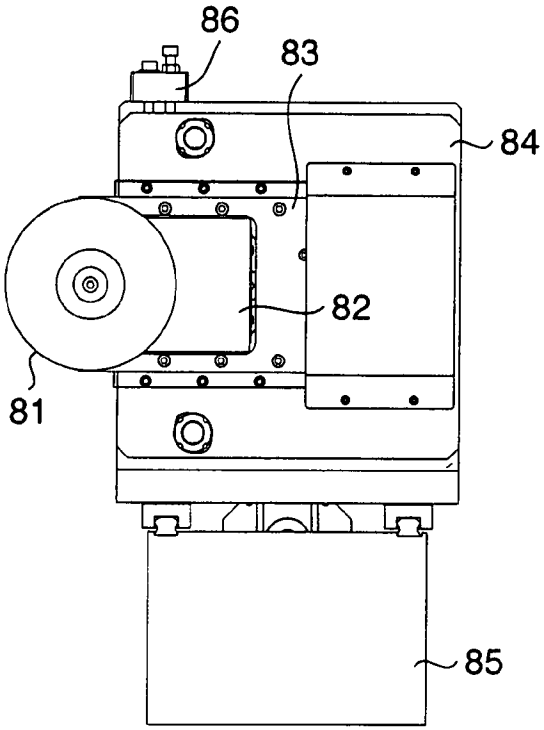
Figure 18A:
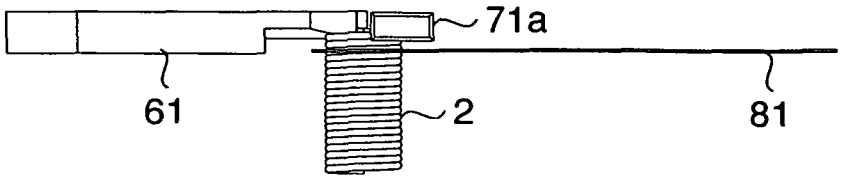
FIGS. 18A and 18B are views respectively seen from the directions Z and X, and show positional relations of the guide, helicoid, pointing tool, and discoid grindstone in the forming space.
Figure 18B:
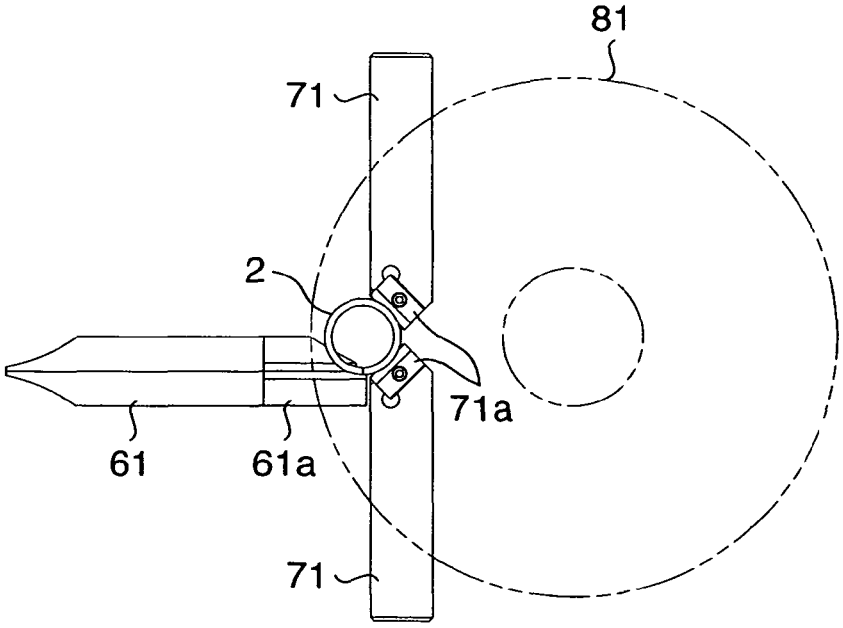
Figure 19:
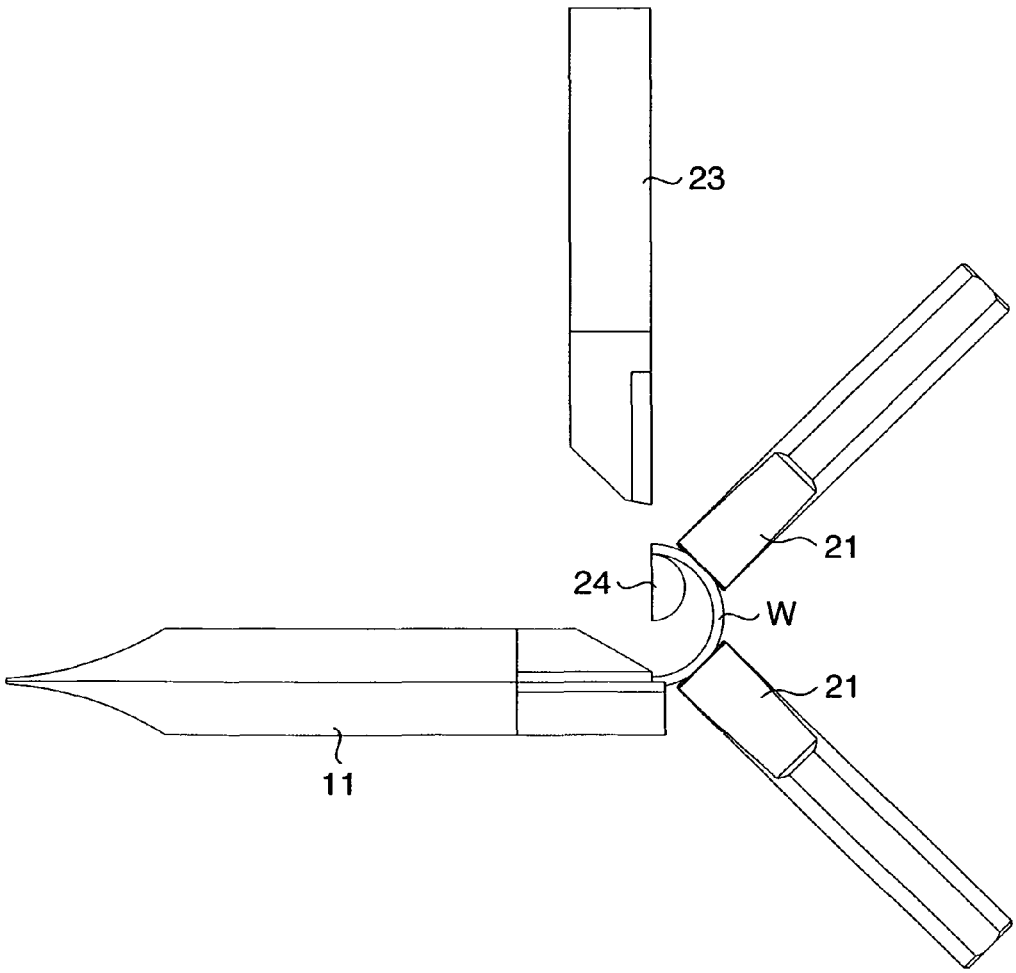
FIG. 19 is an explanatory view of a wire cutting method using a conventional spring manufacturing apparatus.
Figure 20:
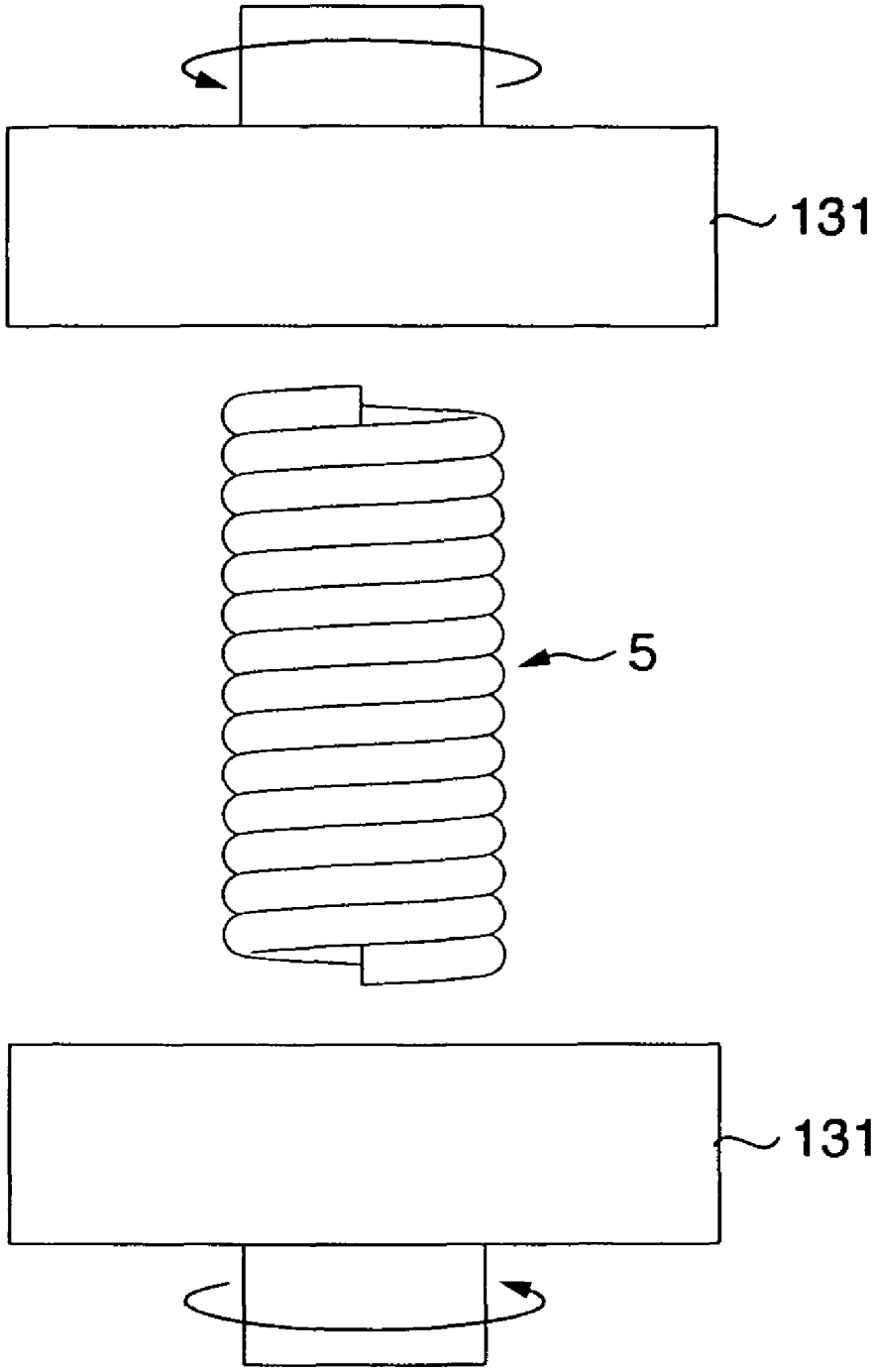
FIGS. 20 to 22 are explanatory views of a processing method for flattening the surfaces of both end portions of a spring by a conventional grinding machine.
Figure 21:
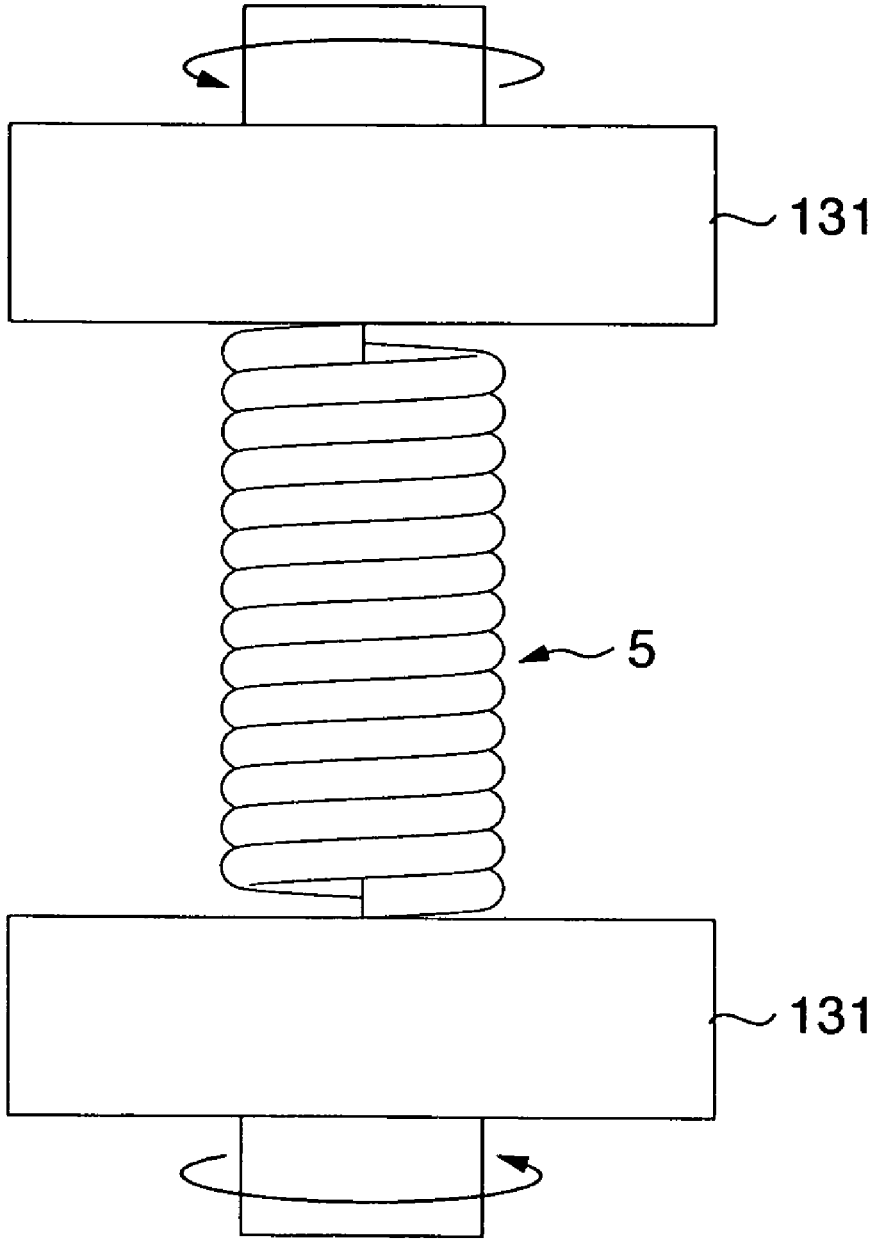
Figure 22:
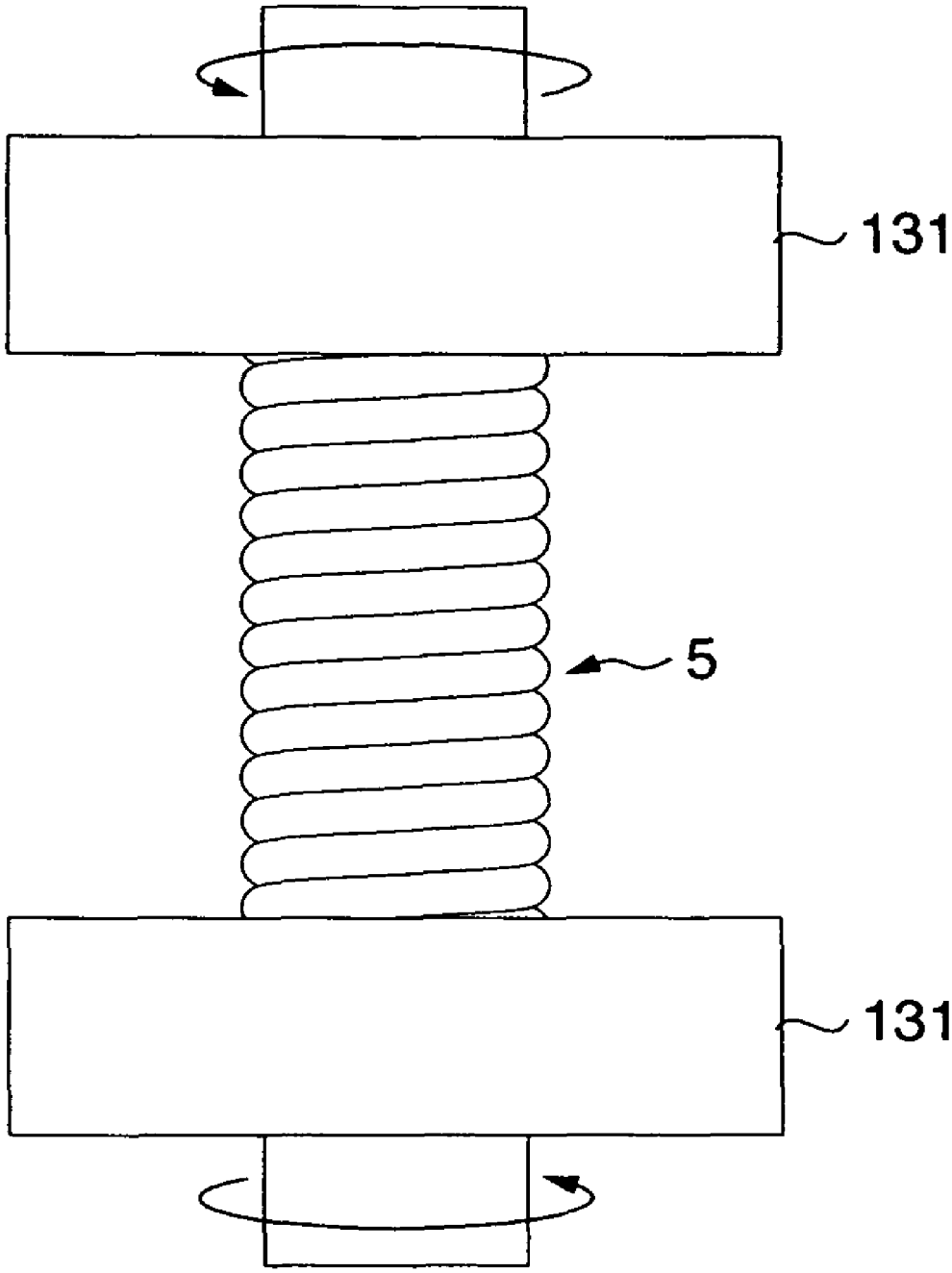
Figure 23A:
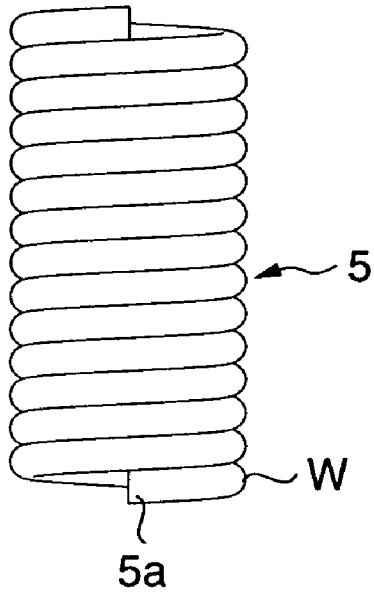
FIGS. 23A and 23B are respectively a front elevation and a side elevation showing an outer shape of a spring processed by the conventional grinding machine.
Figure 23B:
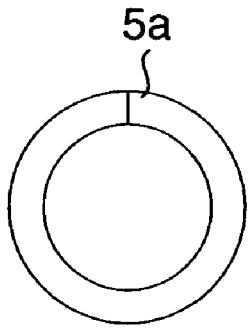
Figure 24A:
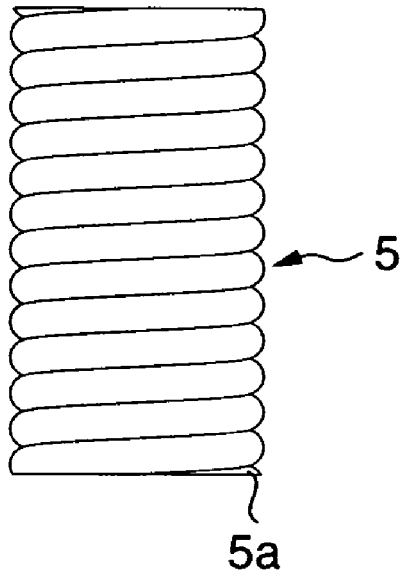
FIGS. 24A and 24B are respectively a front elevation and a side elevation showing an outer shape of a spring processed by the conventional grinding machine.
Figure 24B:
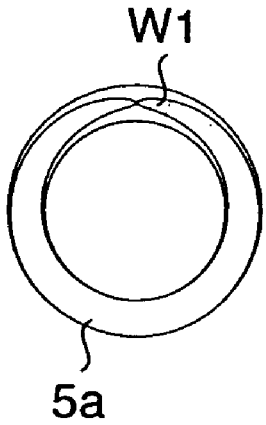
Figure 25A:
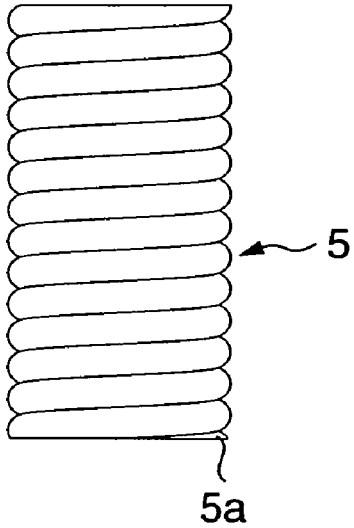
FIGS. 25A and 25B are respectively a front elevation and a side elevation showing an outer shape of a spring processed by the conventional grinding machine.
Figure 25B:
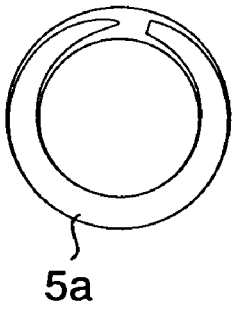
Figure 26A:
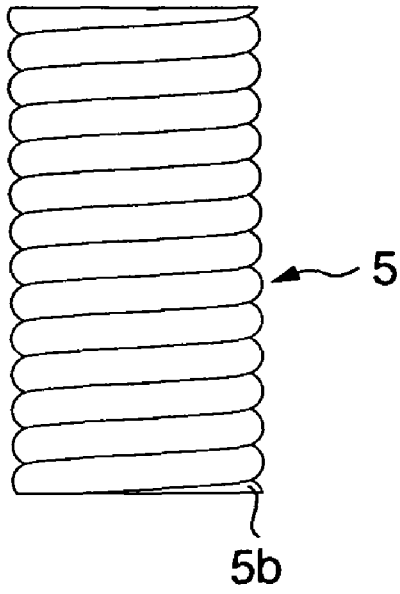
FIGS. 26A and 26B are respectively a front elevation and a side elevation showing an outer shape of a spring processed by the conventional grinding machine.
Figure 26B:
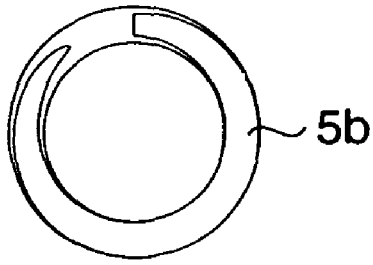

FIG. 15 is a perspective view showing an external appearance of a helical part manufacturing apparatus according to the third embodiment of the present invention. In the drawing, the discoid grindstone of the grindstone tool unit can be seen through. FIG. 16 is a perspective view showing an external appearance of the grindstone tool unit according to the third embodiment. FIGS. 17A and 17B are respectively a front elevation and a side elevation of the grindstone tool unit shown in FIG. 16. FIGS. 18A and 18B are views respectively seen from the directions Z and X, and show positional relations of the guide, helicoid, pointing tool, and discoid grindstone in the forming space. Note that the chuck is omitted in FIG. 15.

In FIG. 15 to 18A-18B, the helical part manufacturing apparatus according to the third embodiment comprises: a wire feeding unit 60 which feeds a wire W to a forming space (tool) above the forming table, two tool units 70 which are struck against the wire W fed from the wire feeding unit 60 for forcibly bending and helically winding the wire W, a grindstone tool unit 80, and a laser unit 90. Note that the measurement unit which measures a coil length and an external diameter of the discoid grindstone is not shown in the drawing. Also, the laser unit is omitted in FIGS. 16, 17A and 17B. The functions of the respective units 60 to 90 are similar to those described in the first and second embodiments, and these units are controlled by the CPU 100 shown in FIG. 4.

The wire feeding unit 60 comprises a guide 61 which guides the wire W from a wire supplying source (not shown) to the forming space, and two pairs of vertically-arranged feed rollers 62 which tightly grip the wire W in the mid-flow of the guide 61 and feed the wire W to the forming space.

Each of the tool units 70 comprises a pointing tool 71 which is arranged opposite to the end portion 61*a* of the guide 61. While the wire W is pushed out by the feed rollers 62, the wire W is struck against each pointing tool 71, thereby being forcibly bent and helically wound to form a helicoid 2. Note that the tool units 70 are arranged in a manner that the two pointing tools normally form an angle of 90°.

The grindstone tool unit 80 is arranged in a manner that the grindstone 81 moves along the wire feeding direction and is positioned opposite to the wire feeding direction. The pair of tool units 70 are arranged at the position where the grindstone tool units 30 are arranged in the first embodiment, i.e., the pair of tool units 70 are arranged vertically in Z direction with respect to the forming space.

The tool unit 70 drives the pointing tool 71 in the vertical direction. At the end portion 71*a* of the pointing tool 71, a groove which is inclined to face the pushed-out wire is formed. For other configurations that are similar to those of FIG. 1, identical reference numerals are assigned and descriptions thereof are omitted.

The grindstone tool unit 80 comprises: a grindstone supporting unit 82 which supports the discoid grindstone 81 rotatable, a Y-direction driving table 83 which moves the grindstone supporting unit 82 in Y direction, an X-direction driving table 84 which moves the Y-direction driving table 83 in X direction, and a base 85 which supports the X-direction driving table 84 so as to be movable in X direction. Note that the position of the discoid grindstone 81 in Z direction is adjusted by an adjustment screw 86.

Further, the grindstone tool unit 80 comprises: a rotation driving motor 87 which rotates the discoid grindstone 81, a Y-direction driving motor (not shown) which moves the Y-direction driving table in Y direction, and an X-direction driving motor 88 which moves the X-direction driving table 84 in X direction.

Note that the Y-direction driving table 83 may be configured so as to be moved also in Z direction by a motor.

The laser unit 90, provided above the discoid grindstone 81 with respect to X direction, is mounted to the grindstone supporting unit 82. Similar to the discoid grindstone 81, the laser unit 90 is movable in Y-Z direction.

Note that cutting process executed by the manufacturing apparatus according to the third embodiment is similar to the above-described cutting process 1.

As mentioned above in the modification of the first embodiment, the grindstone tool unit 80 according to the third embodiment can be applied as grinding unit to process the outer shape of a helical part.

According to the third embodiment, it is possible to make the arrangement space of the discoid grindstone 81 large. Therefore, compared to the first and second embodiments, it is possible to make the external diameter of the grindstone larger thereby make the abrasive area larger and prolong the life of the grindstone.

Fourth Embodiment

In the third embodiment, the wire feeding unit 60, the tool unit 7, and the grindstone tool unit 80 were each mounted onto a separated device. In contrast, the wire feeding unit, the tool unit and the grindstone tool unit are all mounted on the same device in the fourth embodiment, and also that the tool unit and the grindstone tool unit are mounted on a common table which can be vertically movable.

Figure 27A:
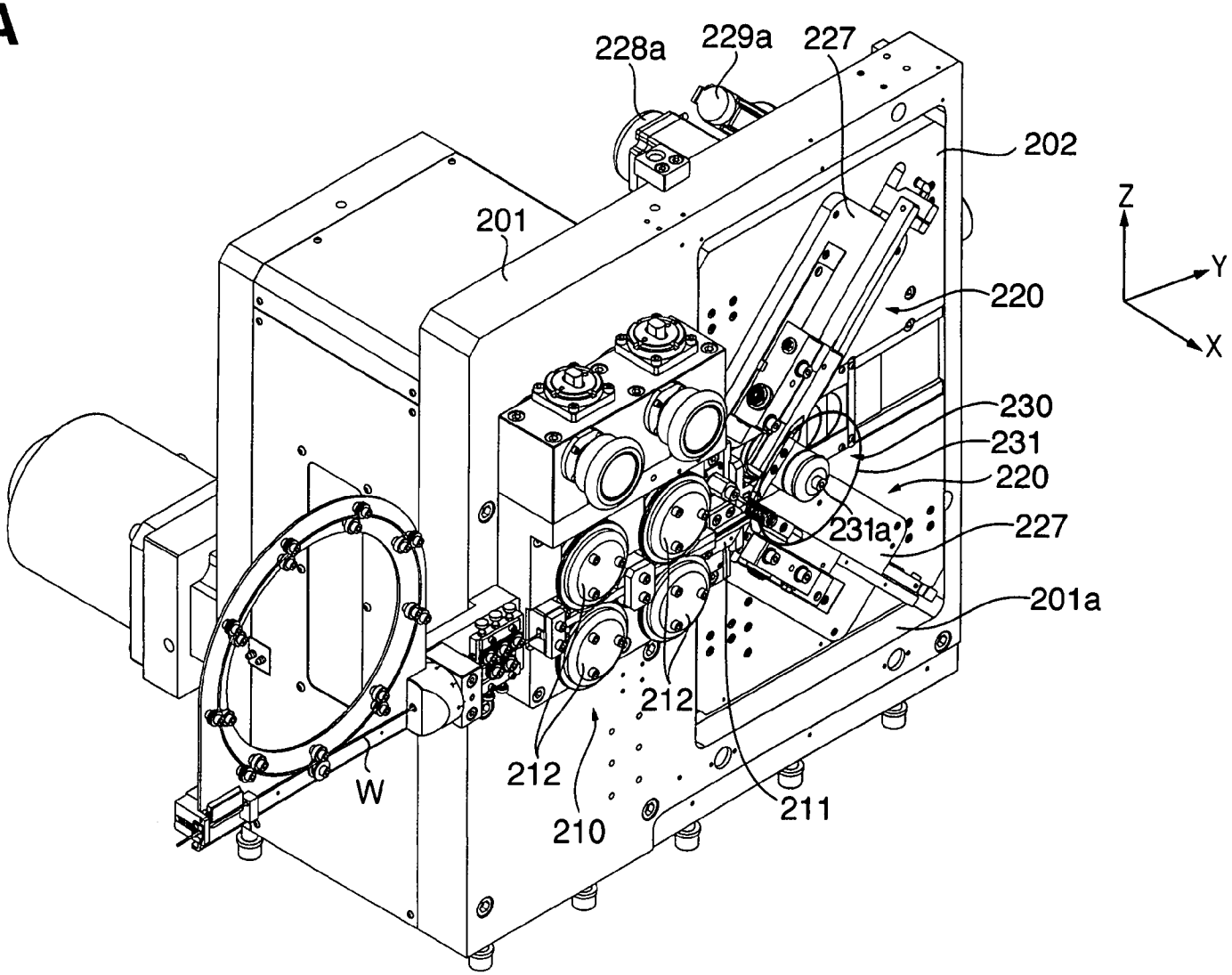
Figure 27B:
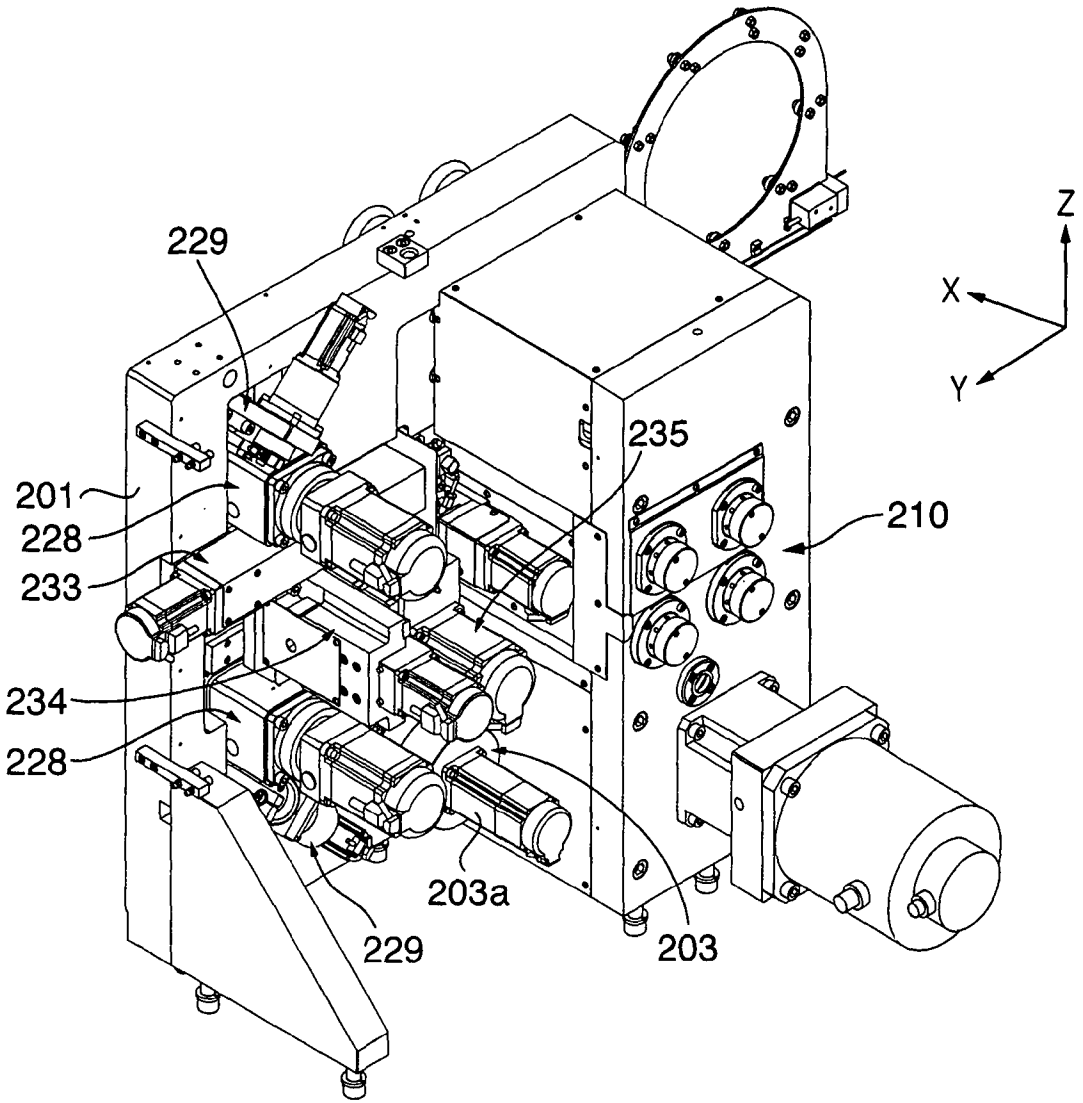
Figure 28:
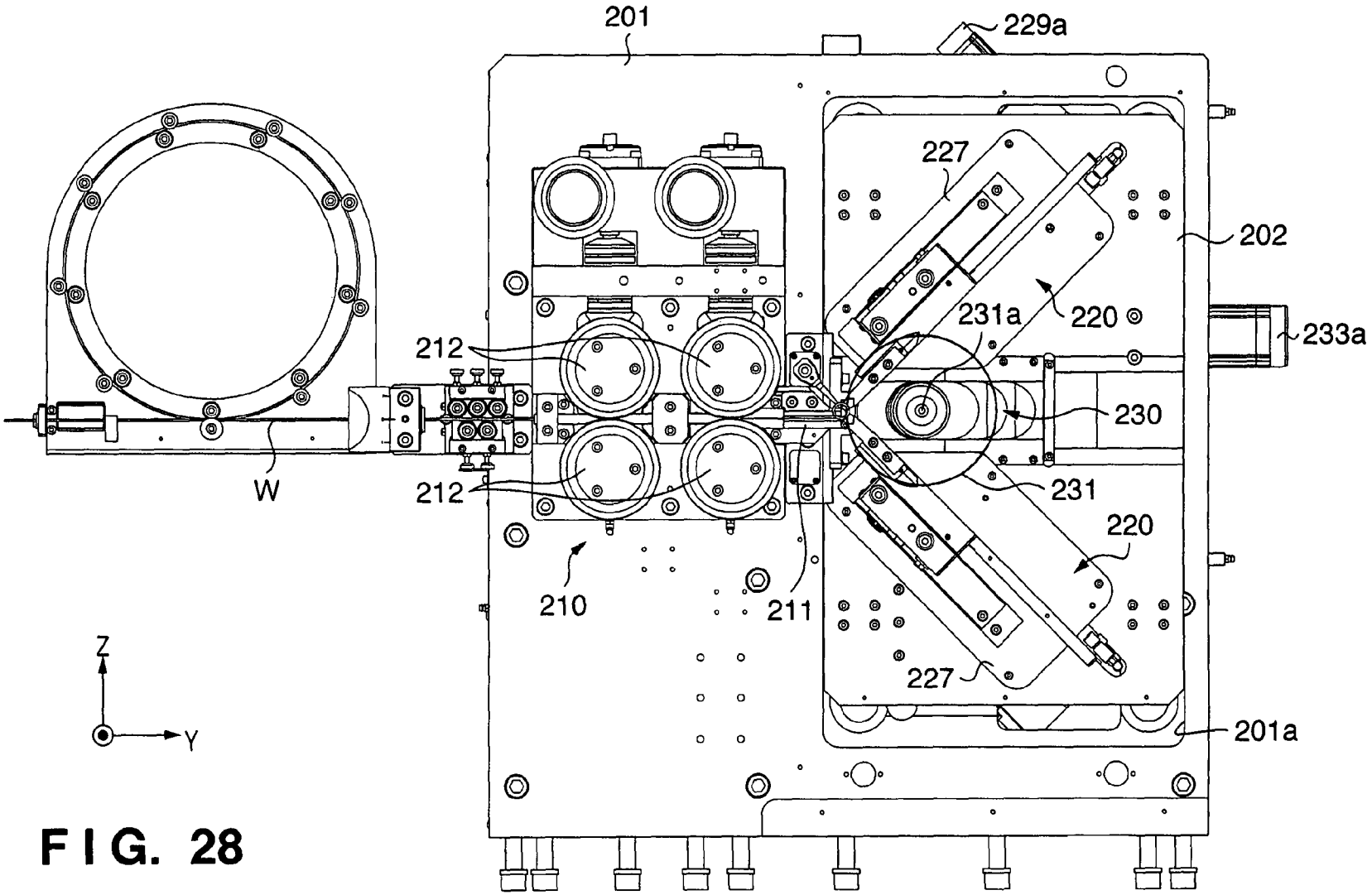
FIG. 28 is a front elevation shown in FIG. 27A.
Figure 29A:
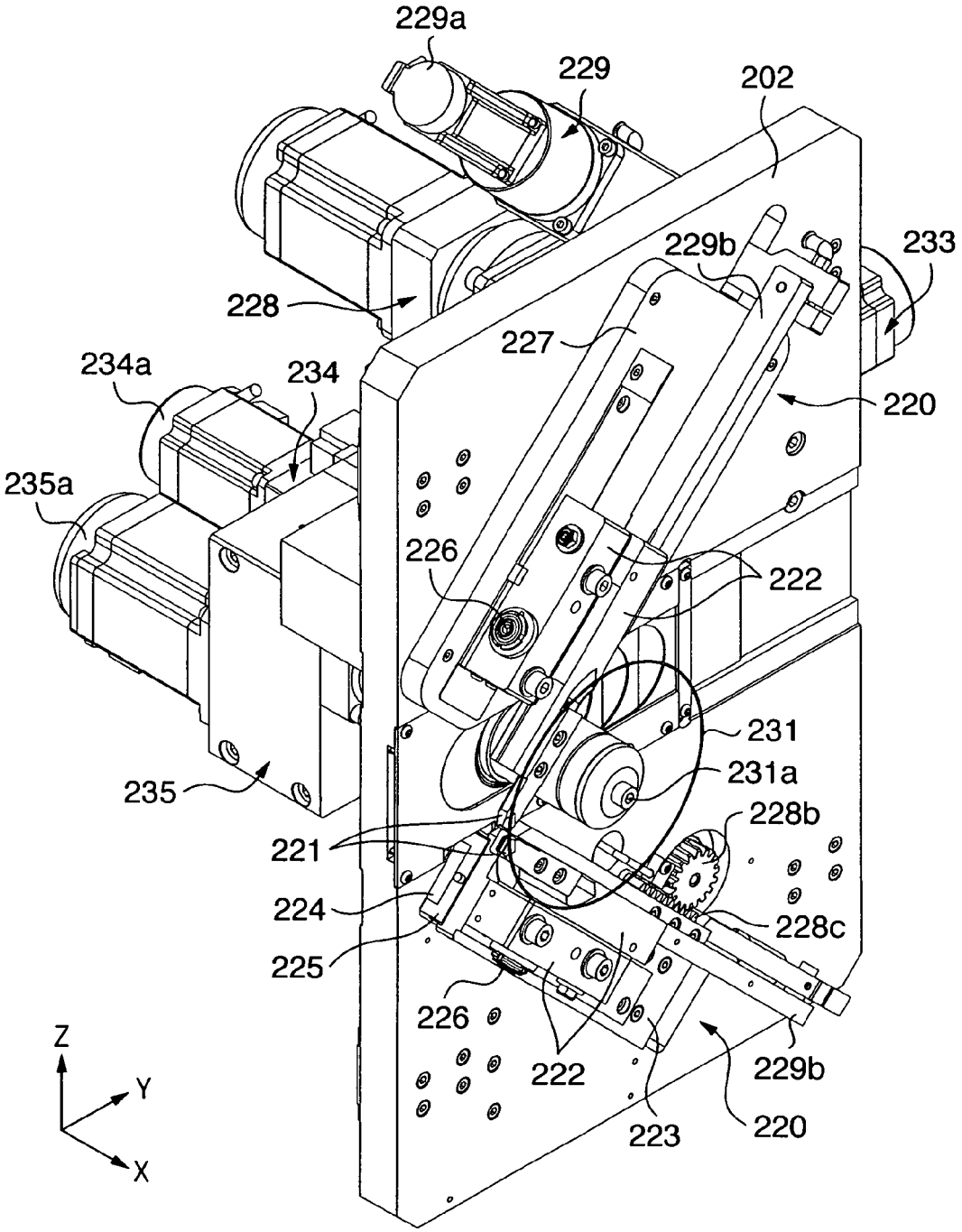
FIG. 29A is a front perspective view showing a vertically moving table of the present embodiment, in which the cover of the lower tool unit is removed.
Figure 29B:
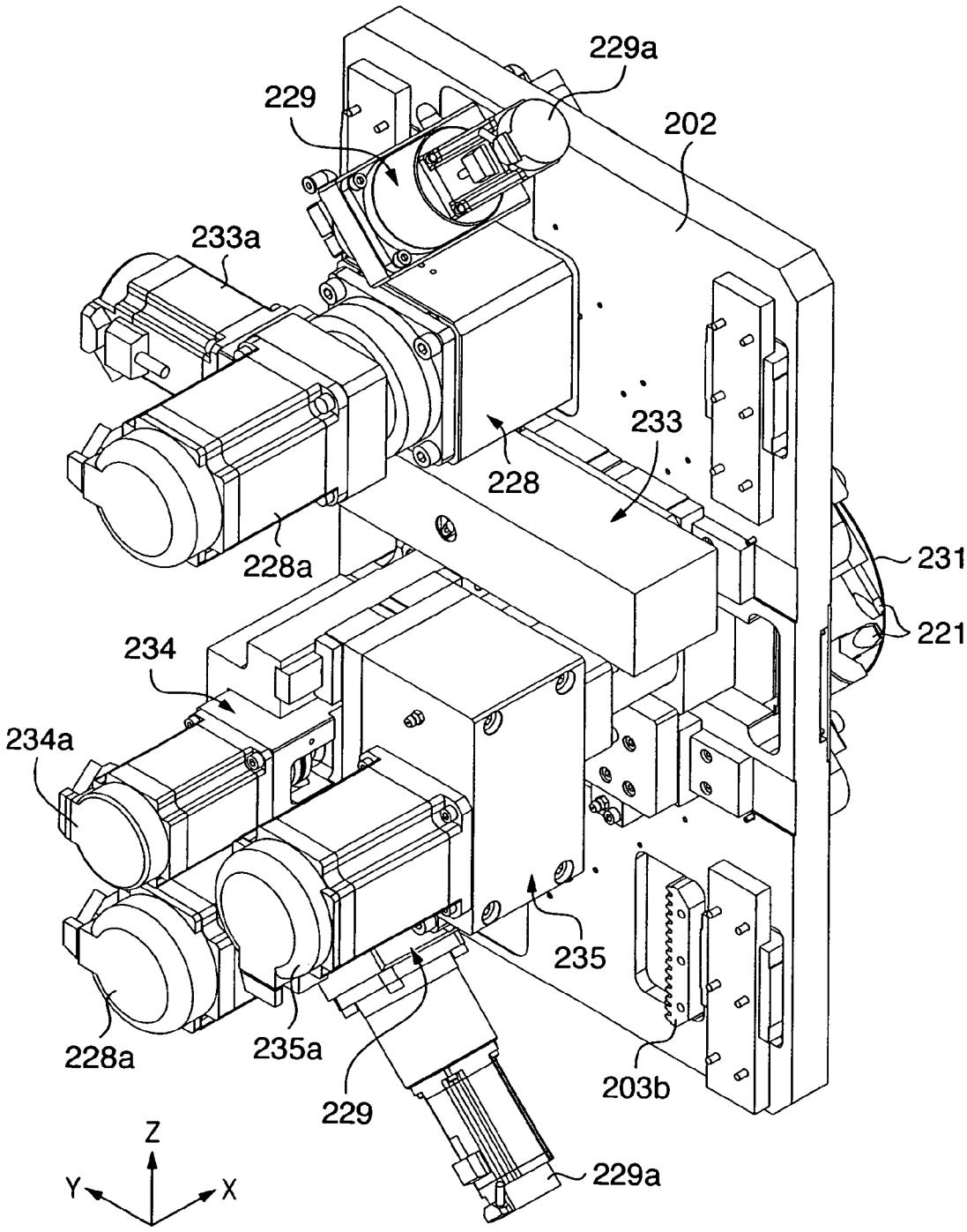
FIG. 29B is a rear perspective view showing the vertically moving table of the present embodiment, in which the cover of the lower tool unit is removed.
Figure 30B:
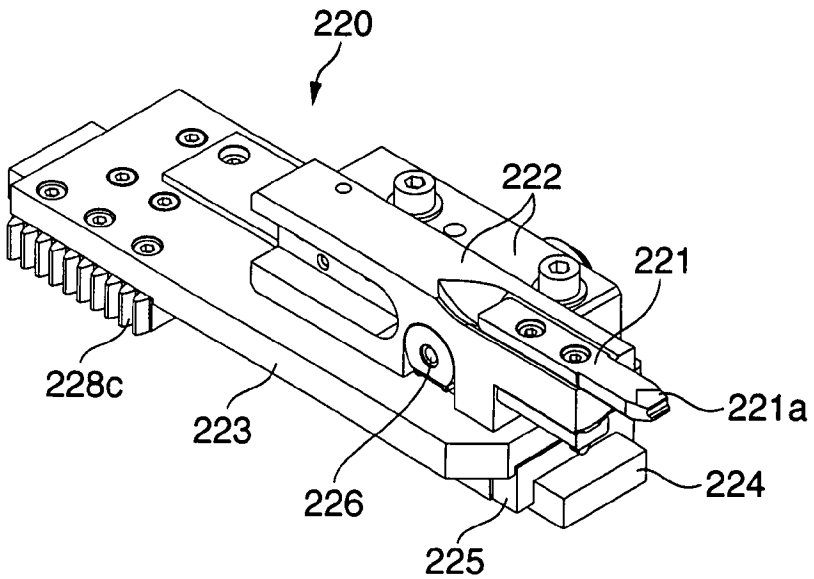
FIGS. 30A and 30B are perspective views of tool units shown in FIGS. 27A to 29B seen in a different direction.
Figure 30A:
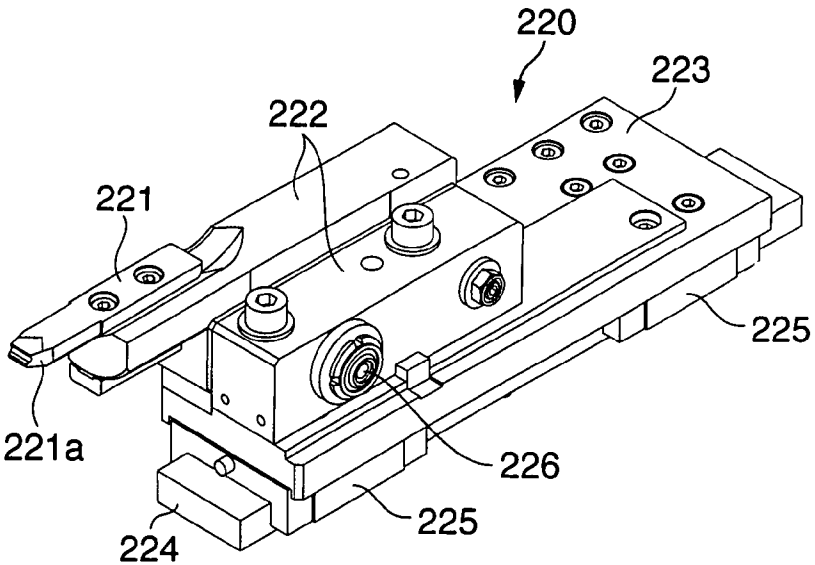

FIGS. 27A and B are front and rear perspective views of a helical part manufacturing apparatus according to the fourth embodiment of the present invention, where a discoid grindstone of a grindstone tool unit can be seen through. FIG. 28 is a front view of FIG. 27A. FIGS. 29A and B are front and rear perspective views showing the vertically moving table of the present embodiment, in which the cover of the lower tool unit is detached. FIGS. 30A and 30B are perspective views of the tool unit shown in FIGS. 27A to 29B seen in a different direction.

In FIGS. 27A to 29B, the helical part manufacturing apparatus according to the present embodiment comprises a rectangular base table 201 mounted on top of a box-shaped base (not shown), and a vertically moving table arranged on the base table 201.

The wire feeding unit 210 and the guide 211 are mounted on the base table 201. Further, the tool unit 220 and the grindstone tool unit 230 are mounted on the vertically moving table 202. The structure of a wire feeding unit 210 is identical to that of the third embodiment. Further explanation will therefore be omitted.

The vertically moving table 202 is arranged in a concave portion 201*a*, and is driven within a predetermined range (20 mm each in upward and downward directions from the wire as the center, hence approximately 40 mm in total) by the vertically moving table driving unit 203 which has a rack & pinion mechanism (only a rack 203*b* is shown) and a vertically driving motor 203*a*. The rack 203*b* is arranged on the rear surface of the vertically moving table 202, and the vertically driving motor 203*b* which drives a pinion (not shown) that engages with the rack 203*b* is arranged on the rear surface of the base table 201.

Further, the grindstone tool unit 230 is arranged on the vertically moving table 202 so as to be movable along the wire-feeding direction (Y-direction: left and right direction) and also along the normal direction (X-direction: forward and backward direction) of the table surface. Additionally, the tool units 220 are arranged on the vertically moving table 202 at an angle of about 45° with respect to the wire feeding direction such that the grindstone tool unit 230 is positioned between the upper and lower tool units. Note that each of the tool units 200 is detachable from the vertically moving table 202. Further, at least one of the upper and lower tool units 220 may be mounted on the vertically moving table 202 at an angle which orthogonally crosses the wire feeding direction.

The grindstone tool unit 230 is driven in the left and right direction by the grindstone left and right driving unit 233 which has a ball & screw mechanism (not shown) and a Y-direction driving motor 233*a*. Further, the grindstone tool unit 230 can be driven in the forward and backward direction by the grindstone forward and backward driving unit which has the ball & screw mechanism (not shown) and a grindstone forward and backward driving motor 234*a*. Additionally, the grindstone tool unit 230 can rotate the grindstone 231 by the grindstone rotating unit 235 which has a gear mechanism (not shown) and a grindstone rotating motor 235*a*.

Each of the tool units 220 is slidably driven towards (or away from) a forming space by the tool sliding unit 228 which has a rack & pinion mechanism 228*b* and 28*c* and a tool sliding motor 228*a*. Further, each of the tool units 220 are driven forward and backward by a fine adjustment unit 229 which has a crank mechanism 229*b* and a forward and backward driving motor 229*a*.

The tool units 220, as shown in FIGS. 30A and 30B, has a point tool 221 which forms a helical part of a desired shape by forcibly bending, curving, winding or cutting the wire, a tool holder 222 which holds the point tool 221, a slider 223 onto which the tool holder 222 is attached, and a slider guide 225 which slidably supports slider 223 to a base 224, and the base 224 is mounted to the vertically moving table 202. Further, the tool holder 222 is connected to a crank mechanism 229*b* of said fine adjustment unit 229, and swing the tool at an axis 226 which is parallel to the table surface and perpendicular to the sliding direction of the tool, thereby finely adjusting the position of the point tool end portion 221*a* with respect to the wire.

A Rack 228*c* is attached on the slider 223, and is driven by engaging with the pinion 228*b* attached to the output shaft of the tool sliding motor 228*a*. A cover 227, which protects the slider 223, base 224 and the slider guide 225, is attached to the tool unit 220 at a state where the tool unit 220 is mounted onto the vertically moving table 202.

Obviously, tool types, positions, and the like can be arbitrarily set. As the tool units 220, tools other than the point tool as shown in the figures, e.g., a bending tool, holding tool, and the like having different shapes can be mounted.

In the present embodiment, as is the case in the third embodiment, the discoid grindstone 231 of the grindstone tool unit 230 is positioned such that the moving direction of the discoid grindstone 231 is opposite to the wire feeding direction. For this reason, the wire cutting operation is identical to that of the wire cutting process 1 as mentioned above, which is implemented by driving each of said driving motors 203*a*, 228*a*, 229*a*, 233*a*, 234*a*, 235*a* by the control system shown in FIG. 4.

According to the present invention, in addition to the effect of the third embodiment, by the vertically moving table 202 vertically movable with respect to the base table 201 onto which the wire feeding unit 210 is mounted (in other words, vertically with respect to the wire W fed by the feed roller 212), it is possible to adjust the rotation axis 231*a* of the discoid grindstone 231 of the grindstone tool unit 230 can be adjusted to coincide with the center of the external diameter of the helical part. For this reason, even when the outer shape of the helical part is altered, it is possible to re-set up the relative positions of the tool 221 and the discoid grindstone 231.

Obviously, as mentioned in the modification of the first embodiment, the grindstone tool unit 230 of the fourth embodiment can be adapted as grinding unit for processing the outer shape of the helical part.

Further, the laser unit, and the measurement unit which measures the coil length and the outer diameter of the discoid grindstone, are omitted in the present embodiment.

The present invention is not limited to the above embodiments and various changes and modifications can be made within the spirit and scope of the present invention. Therefore, to apprise the public of the scope of the present invention, the following claims are made.

What is claimed is:

1. An apparatus for manufacturing a helical part by feeding a wire toward a tool and pushing the wire against the tool to forcibly wind the wire, comprising:

a feed roller for feeding the wire toward the tool;

a roller driving unit for rotatably driving said feed roller;

at least one tool holding unit which slidably holds the tool toward a forming space;

a cutting unit, which holds a discoid grindstone rotatable and movable toward the forming space, for cutting the wire by the rotating discoid grindstone; and a control unit for controlling said roller driving unit and said cutting unit to move the discoid grindstone along a plane which is substantially perpendicular to a coil growing direction of the helical part and to cut the wire in a direction which is substantially perpendicular to the coil growing direction;

wherein said tool holding units are arranged vertically in a manner that upper tool and lower tool are arranged at an angle of 45° with respect to the wire feeding direction and that a rotation center of the discoid grindstone is sandwiched between the upper and lower tools, and said cutting unit is arranged in a manner that the discoid grindstone is positioned opposite to the wire feeding direction and the rotation center of the grindstone matches a center of the coil diameter of the helical part.

2. The apparatus according to claim 1, wherein said control unit executes control in a manner that rotation of said feed roller is synchronous with motion of the discoid grindstone driven by said cutting unit so as to cut the wire in a direction which is substantially perpendicular to the coil growing direction while the wire is wound.

3. The apparatus according to claim 1, wherein said discoid grindstone has a thickness equal to or smaller than a diameter of the wire.

4. The apparatus according to claim 1, further comprising a detection unit for detecting an external diameter of said discoid grindstone, wherein said control unit corrects a motion distance of said discoid grindstone driven by said cutting unit based on a variation value of the external diameter of said discoid grindstone which has been calculated from a detection result of said detection unit.

5. The apparatus according to claim 1, further comprising a detection unit for detecting a coil length of the helical part, wherein said control unit controls rotation of the feed roller driven by said roller driving unit and motion of the discoid grindstone driven by said cutting unit based on a coil length of the helical part which has been calculated from a detection result of said detection unit.

6. The apparatus according to claim 1, further comprising a laser unit for cutting part of the helically wound wire by laser, wherein, prior to cutting the helical part by said cutting unit, said laser unit makes a cutting line on the wire corresponding to a cutting position so that an end portion of the wire which will be generated after cutting the helical part is removed.

7. The apparatus according to claim 1, wherein said cutting unit is arranged in a manner that said discoid grindstone moves orthogonal to a feeding direction of the wire.

8. The apparatus according to claim 1, wherein when cutting by said cutting unit is completed, a leading edge of a helical part to be manufactured next is simultaneously formed.

* * * * *